US009983525B2

(12) United States Patent
Eguchi et al.

(10) Patent No.: US 9,983,525 B2
(45) Date of Patent: May 29, 2018

(54) FIXING DEVICE

(71) Applicant: CANON KABUSHIKI KAISHA, Tokyo (JP)

(72) Inventors: Hiroki Eguchi, Yokohama (JP); Tomonori Sato, Gotemba (JP); Yuki Nishizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/358,954

(22) Filed: Nov. 22, 2016

(65) Prior Publication Data

US 2017/0146936 A1 May 25, 2017

(30) Foreign Application Priority Data

Nov. 24, 2015 (JP) ..... 2015-228557

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/2039
See application file for complete search history.

(56) References Cited

U.S. PATENT DOCUMENTS

2015/0168880 A1 6/2015 Jota et al.
2017/0146935 A1* 5/2017 Obata ..... G03G 15/2053
2017/0160682 A1* 6/2017 Nishizawa ..... G03G 15/206

FOREIGN PATENT DOCUMENTS

JP 2001-332378 A 11/2001
JP 2003-323069 A 11/2003
JP 2003-330291 A 11/2003

OTHER PUBLICATIONS

Co-pending U.S. Appl. No. 15/371,837, filed Dec. 7, 2016.

* cited by examiner

*Primary Examiner* — Clayton E LaBalle
*Assistant Examiner* — Michael Harrison
(74) *Attorney, Agent, or Firm* — Fitzpatrick, Cella, Harper & Scinto

(57) ABSTRACT

A fixing device fixes an image on a recording material. The fixing device includes a cylindrical rotatable member with an electroconductive layer and at least one slit at an end portion with respect to a generatrix direction, a coil, inside the rotatable member, the coil including a helically-shaped portion having a helical axis along the generatrix direction and forming an alternating magnetic field for causing the electroconductive layer to generate heat through electromagnetic induction heating, and a magnetic core provided inside the helically-shaped portion. The magnetic core does not form a loop outside the electroconductive layer, 70% or more of magnetic lines of force coming out of one end of the core and passing through an outside of the electroconductive layer return to another end of the core, and the image is fixed on the recording material by the generated heat.

3 Claims, 15 Drawing Sheets

(a)

(b)

(a)

(b)

(a)

(b)

(a)

(b)

(a)

(b)

(a)

(b)

(a)

(b)

(c)

FIXING DEVICE

FIELD OF THE INVENTION AND RELATED ART

The present invention relates to a fixing device of an electromagnetic induction heating type and a rotatable heating member used in this fixing device.

The fixing device mounted in an image forming apparatus, such as a copying machine or a printer, of an electrophotographic type fixes, in general, a toner image on a recording material by heating the recording material, on which an unfixed toner image is carried, while feeding the recording material through a nip formed by a rotatable heating member and a pressing roller contacting the rotatable heating member.

In recent years, a fixing device of an electromagnetic induction heating type, in which an electroconductive layer of the rotatable heating member can be directly heated, has been developed and put into practical use. The fixing device of the electromagnetic induction heating type has an advantage that a warm-up time can be shortened.

However, in this fixing device, when a small-sized recording material is subjected to a fixing process, a temperature excessively increases in a non-sheet-passing region where the recording material does not pass, i.e., a so-called non-sheet-passing portion temperature rise is liable to generate.

Therefore, Japanese Laid-Open Patent Application (JP-A) 2003-330291 discloses a constitution in which magnetic flux generating from a magnetic field generating means is induced into an electroconductive layer of a rotatable heating member and heat generation in a non-sheet-passing region is suppressed using a fixing device in which eddy current is generated in the electroconductive layer. In this constitution, a slit extending an axial direction is provided at a non-sheet-passing portion of the electroconductive layer of the rotatable heating member. A region of the electroconductive layer that is cut away as the slit does not generate heat, and therefore it is possible to suppress the heat generation in the non-sheet-passing region.

However, in the constitution of JP-A 2003-330291, heat is generated by the eddy current at a portion of the non-sheet-passing region of the electroconductive layer, which is not cut away as the slit, so that there is a problem that heat generation suppression in the non-sheet-passing region is not sufficient.

SUMMARY OF THE INVENTION

In view of the above-described problem, a principal object of the present invention is to provide a fixing device including a core for inducing magnetic line of force into a helical exciting coil and capable of effectively suppressing heat generation in a non-sheet-passing region, and to provide a rotatable heating member for use with this fixing device.

According to one aspect, the present invention provides a fixing device for fixing an image on a recording material, comprising a cylindrical rotatable member including an electroconductive layer, a coil, provided inside the rotatable member, for forming an alternating magnetic field for causing the electroconductive layer to generate heat through electromagnetic induction heating, wherein the coil includes a helically-shaped portion having a helical axis along a generatrix direction of the rotatable member, and a magnetic core provided inside the helically-shaped portion, wherein the rotatable member generates heat by a current induced in the electroconductive layer in a circumferential direction of the rotatable member, and the image is fixed on the recording material by the heat of said rotatable member, and wherein the rotatable member is provided with a slit at an end portion thereof with respect to the generatrix direction.

Further features of the present invention will become apparent from the following description of exemplary embodiments with reference to the attached drawings.

DESCRIPTION OF THE EMBODIMENTS

Embodiments (1) Image Forming Apparatus

Figure 4:
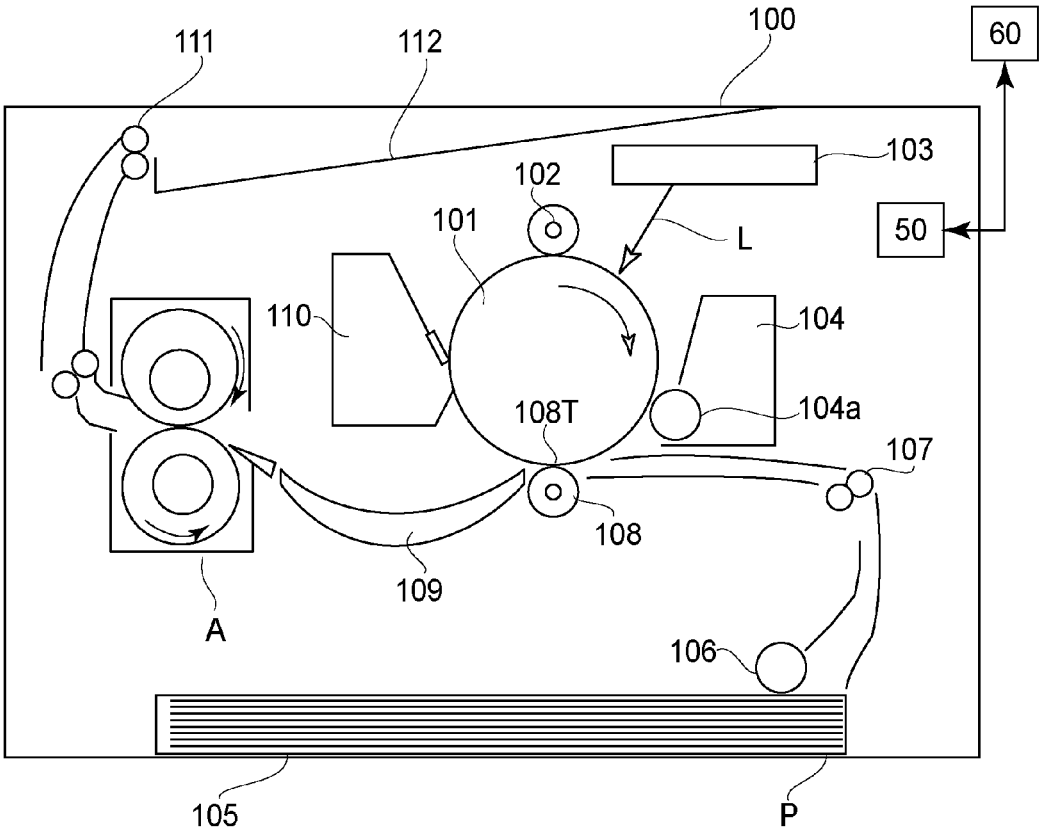
FIG. 4 is a schematic view of an example of an image forming apparatus.

Embodiments of the present invention will be described with reference to the drawings. FIG. 4 is a schematic view showing an example of an image forming apparatus 100 in which a fixing device A in an embodiment is mounted. This image forming apparatus 100 is a laser beam printer of an electrophotographic type and forms, on a recording material P, a toner image corresponding to first information inputted from an external device 60 such as a computer into a controller 50 and then outputs the toner image. The controller 50 effects integrated control of an image forming operation of the image forming apparatus 100.

In the following description, as regards treatment of the recording material P, terms relating to paper (sheet) such as sheet feeding, sheet discharge, a sheet-passing portion, and a non-sheet-passing portion are used for convenience, but the recording material is not limited to paper, and may also include a sheet-shaped member of a material such as a resin material or another material.

A photosensitive drum 101 as an image bearing member is rotationally driven at a predetermined process speed (peripheral speed) in the clockwise direction indicated by an arrow. In a rotation process of the drum 101, the drum 101 is electrically charged uniformly to a predetermined polarity and a predetermined potential by a charging roller 102.

A laser beam scanner 103 as an image exposure means outputs laser light L ON/OFF-modulated correspondingly to a digital image (pixel) signal which is inputted from the external device 60 into the controller 50 and which is generated by an image processing means of the controller 50 and subjects the charged surface of the drum 101 to scanning exposure. By this scanning exposure, electric charges at an exposed light portion of the surface of the drum 101 are removed, so that an electrostatic latent image corresponding to the image signal is formed on the surface of the drum 101.

A developing device 104 includes a developing roller 104*a*. From the developing roller 104*a*, a developer (toner) is supplied to the surface of the drum 101, so that the electrostatic latent image on the surface of the drum 101 is successively developed into a toner image which is a transferable image.

A sheet feeding cassette 105 accommodates a recording material P stacked therein. On the basis of a sheet feeding start signal, a sheet feeding roller 106 is driven, so that the recording materials P in the sheet feeding cassette 105 are separated and fed one by one. Then, the recording material P is introduced at predetermined timing to a transfer portion 108T, which is a contact nip between the drum 101 and a transfer roller 108, rotated in contact with the drum 101, via a registration roller pair 107.

That is, feeding of the recording material P is controlled by the registration roller pair 107, so that a leading end portion of the toner image and a leading end portion of the recording material P reach the transfer portion 108T at the same time. Thereafter, the recording material P is nipped and fed through the transfer portion 108T. During a feeding period, a transfer voltage (transfer bias) controlled at a predetermined level is applied to the transfer roller 108 from an unshown transfer bias applying power (voltage) source. In particular, the transfer bias of an opposite polarity to a charge polarity of the toner is applied to the transfer roller 108, so that the toner image is electrostatically transferred from the surface of the drum 101 onto the surface of the recording material P at the transfer portion 108T.

After the transfer of the toner image onto the surface of the recording material, the recording material P is separated from the surface of the drum 101 and is passed through a feeding guide 109 to be introduced into the fixing device A. On the other hand, after the toner image transfer onto the recording material P, the surface of the drum 101 is cleaned by removing a transfer residual toner, paper dust, or the like, by a cleaning device 110. The recording material P passing through the fixing device A is discharged onto a sheet discharge tray 112 through a sheet discharging opening 111.

(2) Fixing Device

Figure 1:
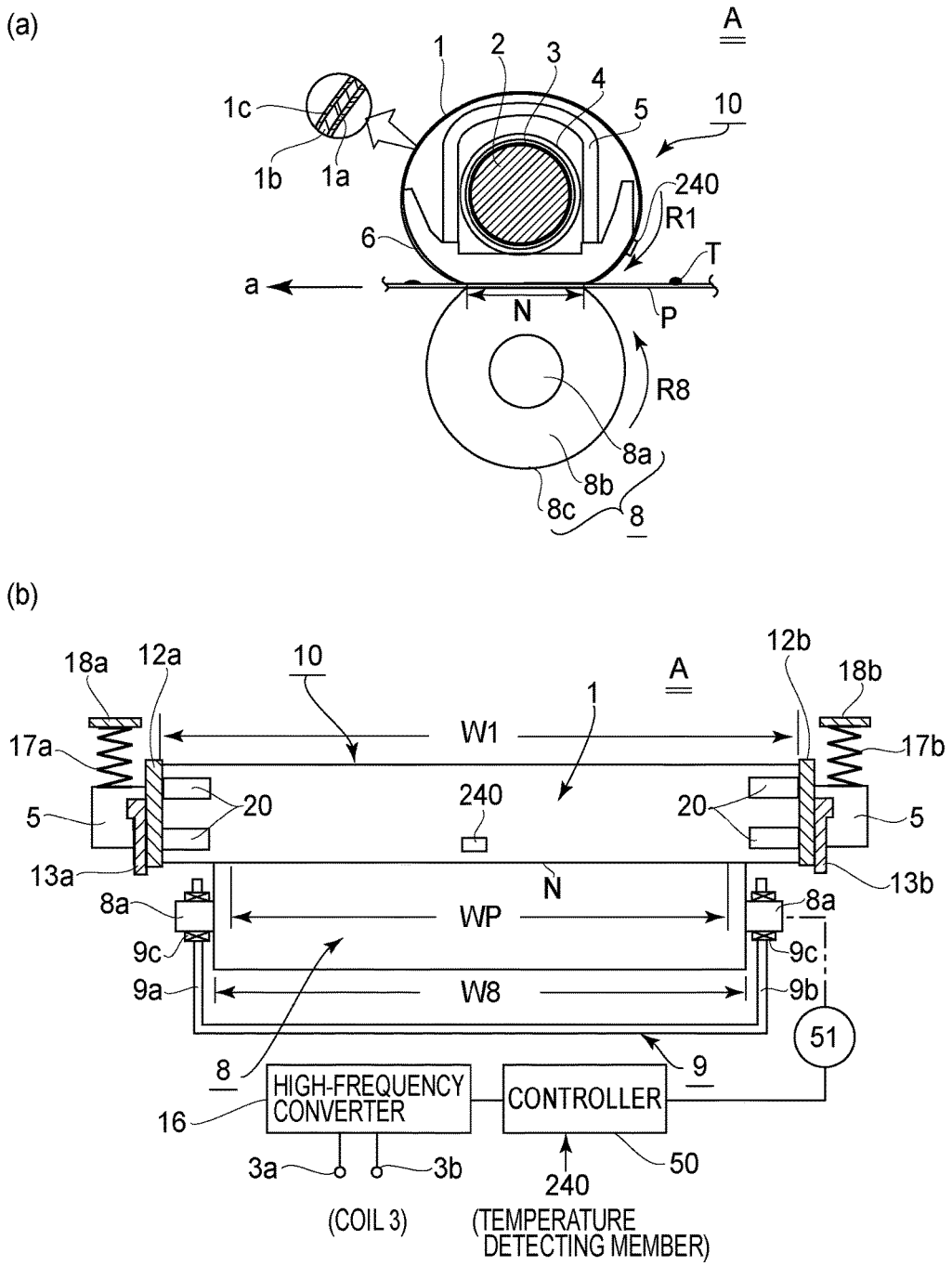
In FIG. 1, (a) and (b) are schematic views for illustrating a fixing device in an embodiment.

In this embodiment, the fixing device A is a device of an electromagnetic induction heating type. In FIG. 1, (a) is a schematic cross-sectional side view of a principal portion of the fixing device A, and (b) is a schematic front view of the principal portion of the fixing device A. This fixing device A roughly includes a heating assembly 10 as a heating member, a pressing roller 8 as a pressing member (nip-forming member), and a device chassis 9 accommodating these members 10 and 8.

The heating assembly 10 includes a fixing sleeve (fixing film) 1 as a cylindrical rotatable member (rotatable heating member) for heating. The heating assembly 10 further includes, as inside members, a magnetic core 2, an exciting coil 3, a coil holder 4, a pressing stay 5 and a sleeve guide (film guide, nip-forming member) 6.

Further, the heating assembly 10 includes flange members 12*a*, 12*b* provided by being externally engaged with the sleeve guide 6 in one end side and the other end side. The flange members 12*a*, 12*b* are fixed at predetermined positions by regulating members 13*a*, 13*b*, respectively. The fixing sleeve 1 is externally fitted loosely around the above-described inside members 2-6 between the flange members 12*a*, 12*b* so as to be rotatable.

The pressing roller 8 is constituted by a metal core 8*a* and an elastic material layer (electric layer) 8*b* molded and coated in a roller shape concentrically integral with the metal 8*a*, and a parting layer 8*c* is provided as a surface layer. The electric layer 8*b* may preferably be formed of a material having a good heat-resistant property, such as silicone rubber, a fluorine-containing rubber, or a fluorosilicone rubber. The metal core 8*a* is held and disposed rotatably between side plates 9*a*, 9*b* of the device chassis 9 in one end side and the other end side via electroconductive bearings 9*c*.

The heating assembly 10 is disposed substantially in parallel to the pressing roller 8, on a side of the pressing roller 8 so that the sleeve guide 6 opposes the pressing roller 8. Further, pressing springs 17*a*, 17*b* are compressedly provided between the pressing stay 5 and spring receiving members 18*a*, 18*b* in one end side and the other end side, so that a pressing-down force is caused to act on the stay 5. In the fixing device A in this embodiment, a pressing force of about 100 N to about 300 N (about 10 kgf to about 30 kgf) as a total pressure is applied.

As a result, the fixing sleeve 1, contacting a lower surface of the sleeve guide 6 constituted by a heat-resistant resin material, such as PPS, and an upper surface of the pressing roller 8 are press-contacted to each other against elasticity of the electric layer 8*b* of the pressing roller 8, so that a fixing nip N having a predetermined width with respect to a recording material feeding direction a is formed.

The pressing roller 8 is rotationally driven at a predetermined peripheral speed in the counterclockwise direction indicated by an arrow R8 by transmitting a driving force from a driving means (motor) 51 controlled by the controller 50 to the metal core 8*a* via a drive transmitting mechanism (not shown). With this drive of the pressing roller 8, a rotational force is caused to act on the fixing sleeve 1 by a frictional force between the pressing roller 8 and an outer surface of the fixing sleeve 1 at the fixing nip N, so that the fixing sleeve 1 is rotated by the pressing roller 8 in the clockwise direction indicated by an arrow R1.

The flange members 12*a*, 12*b* perform the function of regulating (preventing) shift movement of the fixing sleeve 1 along a longitudinal direction of the sleeve guide 6 by stopping an end portion of the fixing sleeve 1 during rotation of the fixing sleeve 1. As a material of the flange members 12*a*, 12*b*, a material having a good heat-resistant property such as a LCP (liquid crystal polymer) resin material may preferably be used.

Figure 2:
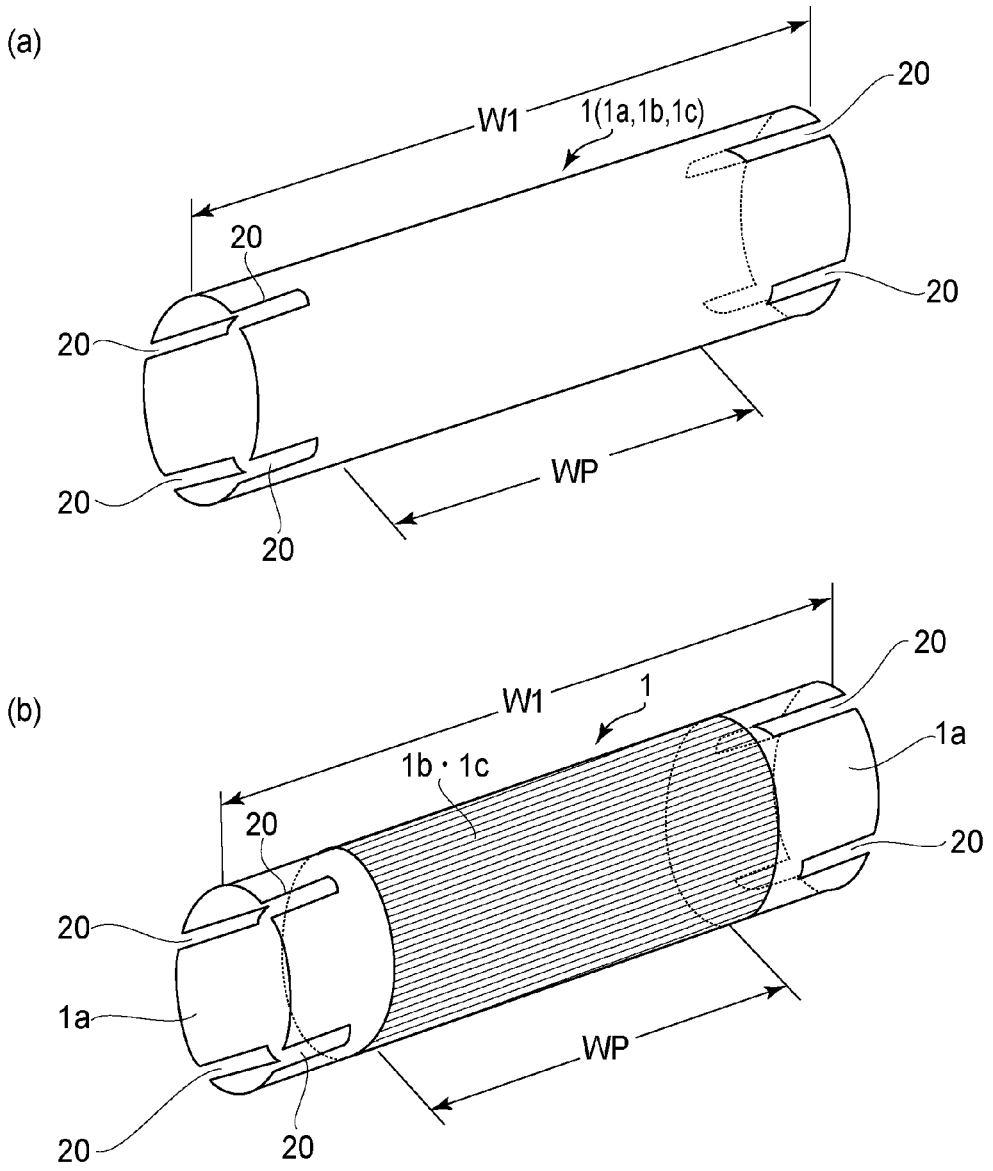
In FIG. 2, (a) and (b) are perspective views for illustrating a fixing sleeve.

The fixing sleeve 1 in this embodiment is a cylindrical rotatable member having a diameter of 10-50 mm and a composite structure including an electroconductive layer 1*a* formed with an electroconductive member constituting a base layer, an electric layer 1*b* laminated on an outer surface of the electroconductive layer 1*a*, and a parting layer 1*c* laminated on an outer surface of the electric layer 1*b*. In FIG. 2, (a) is a schematic perspective view of an outer appearance of the fixing sleeve 1 having the composite structure, wherein slit-shaped cut-away portions 20 are provided at each of end portions of the fixing sleeve 1 and will be described later.

The electroconductive layer 1*a* is a 10-50 μm thick metal sleeve (metal film), and the electric layer 1*b* is molded of silicone rubber having a hardness of 20 degrees (JIS-A, 1 kg load) in a thickness of 0.1 mm-0.3 mm. On the electric layer 1*b*, as the surface (parting) layer 1*c*, a 10 μm-50 μm thick fluorine-containing resin tube is coated.

In FIGS. 1 and 2, W1 is a longitudinal width (longitudinal length) of the fixing sleeve 1, W8 is a longitudinal width of the pressing roller 8 (electric layer 8*b*), and WP is a width of a sheet-passing region of the recording material P (width of the sheet-passing region of a recording material having a maximum width size usable in the fixing device: maximum sheet-passing region width). The longitudinal width W8 of the pressing roller 8 is larger than the width WP of the sheet-passing region, and the longitudinal width W1 of the fixing sleeve 1 is larger than the longitudinal width W8 of the pressing roller 8 (W1>W8>WP).

In a region outside the sheet-passing region WP in each of end portion sides of the electroconductive layer 1*a*, i.e., in a non-sheet-passing region, a plurality of slit-shaped cut-away portions 20, which extend from a fixing sleeve end surface (edge) toward a fixing sleeve central portion along an axis thereof extending in a generatrix direction of the electroconductive layer 1*a*, and which are substantially equidistantly spaced from each other along a circumferential direction of the fixing sleeve, are provided. In this embodiment, the cut-away portions 20, each of 2-10 mm in width (with respect to the circumferential direction of the fixing sleeve) and 5-20 mm in depth (with respect to the generatrix direction of the fixing sleeve), may be formed at one to six positions. In this embodiment, the cut-away portions 20 are formed at 4 positions in each of the end portion sides.

In this embodiment, each of the cut-away portions 20 is provided by cutting away the electroconductive layer 1*a* inclusive of the electric layer 1*b* and the parting layer 1*c*, but it is also possible to prepare a fixing sleeve 1 having the form in which only the electroconductive layer 1*a* is provided with slit-shaped cut-away portions 20.

Further, as shown in (b) of FIG. 2, it is also possible to prepare a fixing sleeve 1 having the form of a layer structure in which the cut-away portions 20 of the electroconductive layer 1*a* are spaced from the electric layer 1*b* and the parting layer 1*c* and do not overlap with the electric layer 1*b* and the parting layer 1*c*. It is also possible to prepare a fixing sleeve 1 having the form consisting only of the electroconductive layer 1*a* without forming the electric layer 1*b* and the parting layer 1*c*. It is further possible to prepare a fixing sleeve 1 having a layer structure of a combination of the electroconductive layer 1*a* with either one of the electric layer 1*b* and the parting layer 1*c*.

The exciting coil 3 has a helically-shaped portion provided inside the fixing sleeve 1 so that a helical axis is (substantially) parallel to the generatrix direction of the fixing sleeve 1, and is a coil for inducing magnetic line of force of an alternating magnetic field for causing the electroconductive layer 1*a* to generate heat through electromagnetic induction heating. The core 2 is provided inside the helically-shaped portion of the coil 3 and is a magnetic core material for inducing the magnetic line of force of the above-described alternating magnetic field.

The alternating magnetic field is caused to act on the electroconductive layer 1*a*, so that an induced current is generated and thus the electroconductive layer 1*a* generates heat. This heat is conducted to the electric layer 1*b* and the parting layer 1*c* and an entirety of the fixing sleeve 1 is heated, so that the recording material P passed through the fixing nip N is heated and thus the toner image is fixed.

Figure 3:
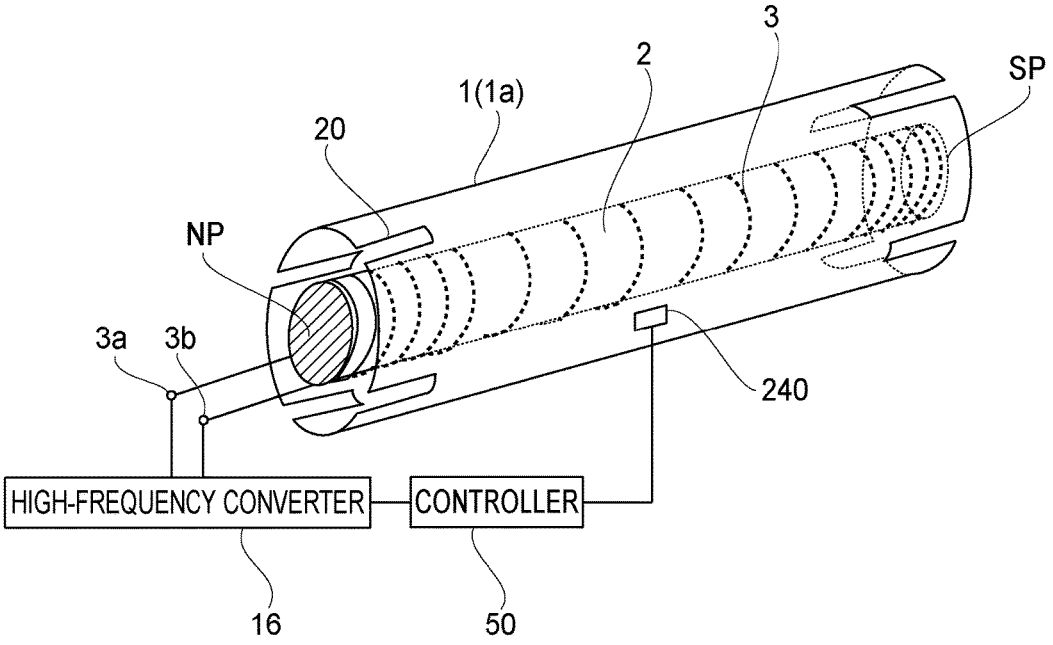
FIG. 3 is a perspective view of the fixing sleeve, a magnetic core and an exciting coil.

A mechanism for generating the induced current by causing the alternating magnetic flux to act on the electroconductive layer 1*a* will be specifically described. FIG. 3 is a perspective view of the electroconductive layer 1*a* of the fixing sleeve 1, the magnetic core 2 and the exciting coil 3.

The core 2, as the magnetic core material, forms a linear open magnetic circuit having magnetic poles NP, SP by penetrating a hollow portion of the fixing sleeve 1 by an unshown fixing (securing) means. As a material of the core 2, a material having a low hysteresis loss and a high relative permeability, for example, a ferromagnetic member constituted by a high-permeability oxide or alloy material, such as sintered ferrite, ferrite resin, amorphous alloy, permalloy, or the like, may preferably be used. In this embodiment, sintered ferrite having a relative permeability of 1800 is used. The core 2 has a cylindrical shape of 5-40 mm in diameter and is 240 mm in longitudinal length.

The coil 3 is formed by helically winding an ordinary single lead wire around the core 2 at the hollow portion of the fixing sleeve 1. At that time, the coil 3 is wound around the core 2 so that a winding interval is dense (narrow) at an end portion of the open magnetic path and is sparse (broad) at a central portion of the open magnetic path. The coil 3 is wound 18 times around the core 2 of 240 mm in longitudinal length. The winding interval is 10 mm at the end portion, 20 mm at the central portion and 15 mm at an intermediate portion between the end portion and the central portion.

The coil 3 is wound in a direction crossing the generatrix direction of the fixing sleeve 1, and therefore, a high-frequency current is caused to flowing through the coil 3 by a high-frequency converter (exciting circuit) 16 via electric power supplying contact portions 3*a* and 3*b*, so that alternating magnetic flux is generated. This alternating magnetic flux acts on the electroconductive layer 1*a* and the inducted current is generated, so that the electroconductive layer 1*a* generates heat. This heat is conducted to the electric layer 1*b* and the parting layer 1*c*, so that the entirety of the fixing sleeve 1 is heated.

A temperature detecting member 240 for detecting a surface temperature of the fixing sleeve 1 is, e.g., a thermistor of a contact type or a non-contact type. The controller 50 controls electric power, on the basis of the temperature detected by the temperature detecting member 240, supplied from the high-frequency converter 16 to the coil 3 so that the surface temperature of the fixing sleeve 1 is raised to a predetermined target temperature and is kept at the target temperature (for example, frequency modulation control).

(3) Heat Generation Principle of Case where Electroconductive Layer of Fixing Sleeve is not Provided with Cut-Away Portions A heat generation principle in this embodiment in the case where the electroconductive layer 1*a* of the fixing sleeve 1 is not provided with the cut-away portions 20 will be described.

3-1) Shape of Magnetic Line of Force and Induced Electromotive Force

With reference to (a) of FIG. 5, a heat-generating mechanism of the fixing device A in this embodiment will be described.

The magnetic lines of force generated by passing an AC current through the coil 3 pass through an inside of the core 2 inside the electroconductive layer 1*a* of the fixing sleeve 1 in the generatrix direction (a direction from S toward N), and then move to an outside of the electroconductive layer 1*a* from one end (N) of the core 2 and return to the other end (S) of the core 2. As a result, the induced electromotive force for generating magnetic lines of force directed in a direction preventing an increase and a decrease of magnetic flux penetrating the inside of the electroconductive layer 1*a* in the generatrix direction of the electroconductive layer 1*a* is generated in the electroconductive layer 1*a*, so that the current is indicated along a circumferential direction of the electroconductive layer 1*a*. This current flowing through the circumferential direction is a current uniformly flowing through the electroconductive layer 1*a* in any region with respect to a thickness direction of the electroconductive layer 1*a*.

By the Joule heat due to this induced current, the electroconductive layer 1*a* generates heat. A magnitude of an induced electromotive force V generated in the electroconductive layer 1*a* is proportional to a change amount per unit time ($\Delta\varphi/\Delta t$) of the magnetic flux passing through the inside of the electroconductive layer 1*a* and a winding number N of the coil 3, as shown in the following formula (1).

$$V = -N\frac{\Delta\Phi}{\Delta t} \tag{1}$$

Figure 5:
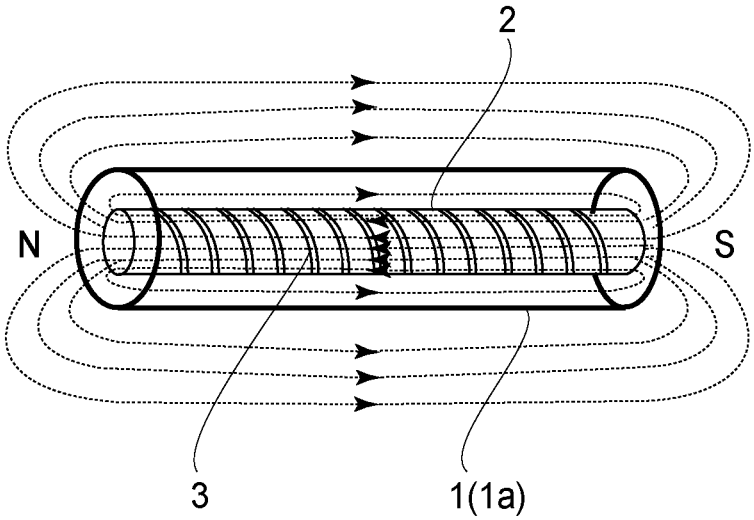
In FIG. 5, (a) and (b) are schematic views showing magnetic fields in an open magnetic path and a closed magnetic path, respectively.
Figure 5:
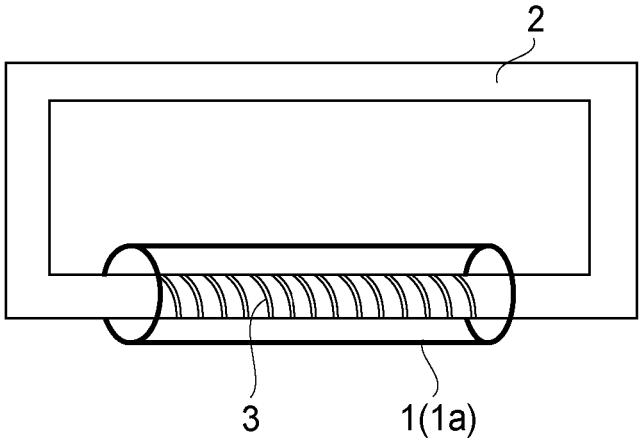

3-2) Relationship Between Proportion of Magnetic Flux Passing Through Outside of Electroconductive Layer and Conversion Efficiency of Electric Power The core 2 in (a) of FIG. 5 does not form a loop and has a shape having end portions. As shown in (b) of FIG. 5, the magnetic lines of force in the fixing device A in which the core 2 forms a loop outside the electroconductive layer 1*a* come out from the inside to the outside of the electroconductive layer 1*a* by being induced in the core 2 and then return to the inside of the electroconductive layer 1*a*.

However, in the case of the constitution in which the core 2 has the end portions, the magnetic lines of force coming out of the end portions of the core 2 are not induced. For that reason, with respect to a path (from N to S) in which the magnetic lines of force coming out of one end of the core 2 return to the other end of the core 2, there is a possibility that the magnetic lines of force pass through both of an outside route in which the magnetic lines of force pass through the outside of the electroconductive layer 1*a* and an inside route in which the magnetic lines of force pass through the inside of the electroconductive layer 1*a*. Hereinafter, a route in which the magnetic lines of force pass through the outside of the electroconductive layer 1*a* from N toward S of the core 2 is referred to as the outside route, and a route in which the magnetic lines of force pass through the inside of the electroconductive layer 1*a* from N toward S of the core 2 is referred to as the inside route.

Of the magnetic lines of force coming out of one end of the core 2, a proportion of the magnetic lines of force passing through the outside route correlates with electric power (conversion efficiency of electric power), consumed by the heat generation of the electroconductive layer 1*a*, of electric power supplied to the coil 3, and is an important parameter. With an increasing proportion of the magnetic lines of force passing through the outside route, the electric power (conversion efficiency of electric power), consumed by the heat generation of the electroconductive layer 1*a*, of the electric power supplied to the coil 3 becomes higher.

The reason therefor is based on a principle that is the same as a phenomenon in which the conversion efficiency of the electric power becomes high when leakage flux is sufficiently small in a transformer and the number of magnetic fluxes passing through the inside of primary winding of the transformer and the number of magnetic fluxes passing through the inside of secondary winding of the transformer are equal to each other. That is, in this embodiment, the conversion efficiency of the electric power becomes higher with a closer degree of the numbers of the magnetic fluxes passing through the inside of the core 2 and the magnetic fluxes passing through the outside route, so that the high-frequency current passed through the coil 3 can be efficiently subjected to, as a circumferential (circulating) current of the electroconductive layer 1*a*, electromagnetic induction.

In (a) of FIG. 5, the magnetic lines of force passing through the inside of the magnetic core 2 from S toward N and the magnetic lines of force passing through the inside route are opposite in direction to each other, and therefore, these magnetic lines of force are cancelled with each other as a whole induction of the electroconductive layers 1*a* including the core 2. As a result, the number of magnetic lines of force (magnetic fluxes) passing through a whole of the inside of the electroconductive layer 1*a* from S toward N decreases, so that a change amount per unit time of the magnetic flux becomes small. When the change amount per unit time of the magnetic flux decreases, the induced electromotive force generated in the electroconductive layer 1*a* becomes small, so that a heat generation amount of the electroconductive layer 1*a* becomes small.

As described above, in order to obtain necessary electric power conversion efficiency by the fixing device A in the Embodiments, control of the proportion of the magnetic lines of force passing through the outside route is important.

3-3) Index Indicating Proportion of Magnetic Flux Passing Through Outside of Electroconductive Layer The proportion passing through the outside route in the fixing device A is represented using an index called permeance representing ease of passing of the magnetic lines of force. First, a general way of thinking about a magnetic circuit will be described. A circuit of a magnetic path along which the magnetic lines of force pass is called the magnetic circuit relative to an electric circuit. When the magnetic flux is calculated in the magnetic circuit, the calculation can be made in accordance with calculation of the current in the electric circuit. To the magnetic circuit, Ohm's law regarding the electric direction is applicable. When the magnetic flux corresponding to the current in the electric circuit is Φ, a magnetomotive force corresponding to the electromotive force is V, and a magnetic reluctance corresponding to an electrical resistance is R, these parameters satisfy the following formula (2).

$$\Phi = V/R \tag{2}$$

However, for describing the principle in an easy-to-understood manner, description will be made using permeance P. When the permeance P is used, the above formula (2) can be represented by the following formula (3).

$$\Phi = V \times P \tag{3}$$

Further, when a length of the magnetic path is B, a cross-sectional area of the magnetic path is S and permeability of the magnetic path is μ, the permeance P can be represented by the following formula (4).

$$P = \mu S/B \tag{4}$$

The permeance P is proportional to the cross-sectional area S and the permeability μ, and is inversely proportional to the magnetic path length B.

Figure 6:
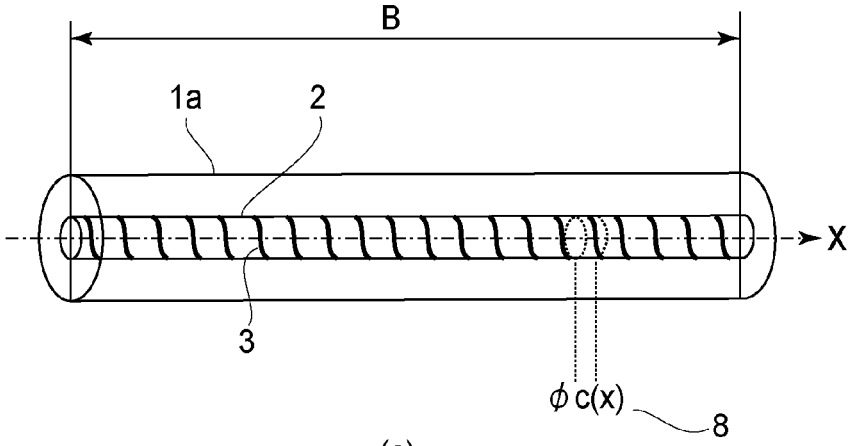
In FIG. 6, (a) and (b) are schematic views showing a structure in which a finite-length solenoid is provided.
Figure 6:
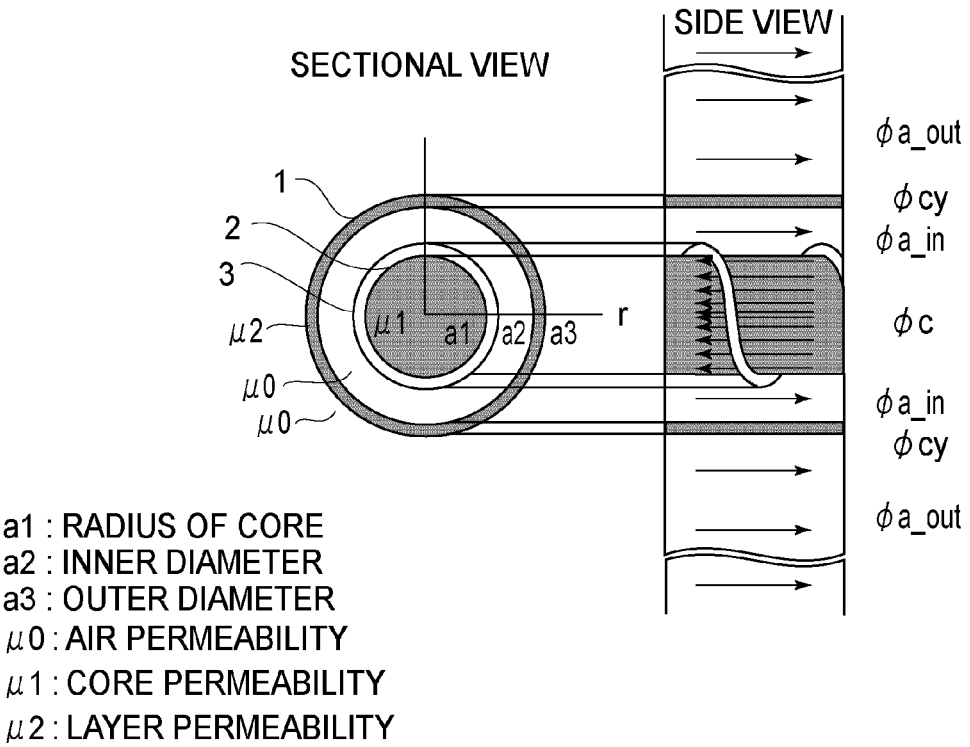

In FIG. 6, (a) is a schematic view showing the coil 3 wound N (times) around the magnetic core 2, of a1 (m) in radius, B (m) in length, and μ1 in relative permeability, inside the electroconductive layer 1*a* in such a manner that a helical axis of the coil 3 is substantially parallel to the generatrix direction of the electroconductive layer 1*a*. In this case, the electroconductive layer 1*a* is an electroconductor of B (m) in length, a2 (m) in inner diameter, a3 (m) in outer diameter, and μ2 in relative permeability. Space permeability induction and outside the electroconductive layer 1*a* is μ0 (H/m). When a current I (A) is passed through the coil 3, the magnetic flux 8 generated per unit length of the magnetic core 2 is φc (x).

In FIG. 6, (b) is a sectional view perpendicular to the longitudinal direction of the magnetic core 2. Arrows in the figure represent magnetic fluxes, parallel to the longitudinal direction of the magnetic core 2, passing through the inside of the magnetic core 2, the induction of the electroconductive layer 1*a*, and the outside of the electroconductive layer 1*a* when the current I is passed through the coil 3. The magnetic flux passing through the inside of the magnetic core 2 is c (=φc (x)), the magnetic flux passing through the inside of the electroconductive layer 1*a* (in a region between the electroconductive layer 1*a* and the magnetic core 2) is φa_in, the magnetic flux passing through the electroconductive layer 1*a* itself is φs, and the magnetic flux passing through the outside of the electroconductive layer 1*a* is φa_out.

Figure 7:
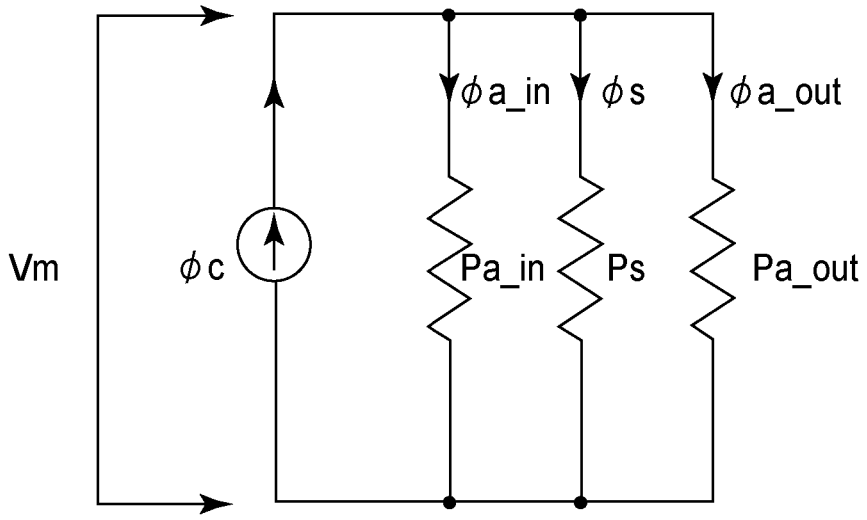
In FIG. 7, (a) and (b) are magnetic equivalent circuit diagrams of a space including a core, a coil and a cylindrical member per unit length.
Figure 7:
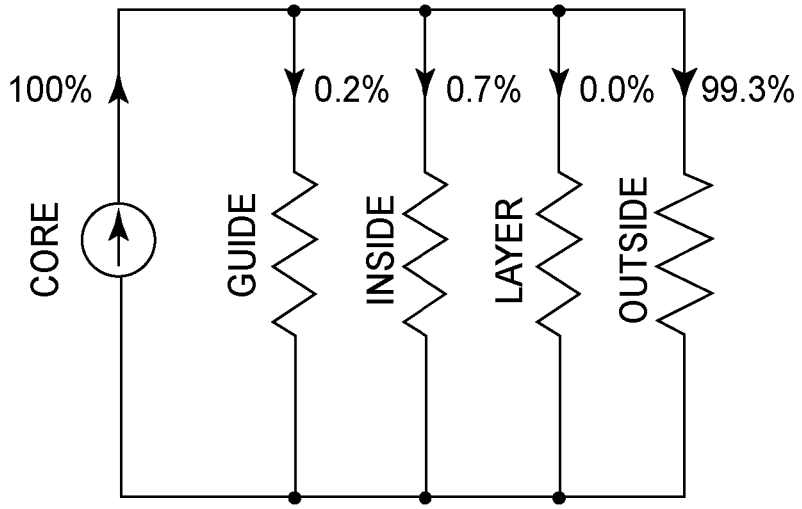

In FIG. 7, (a) shows a magnetic equivalent circuit in a space including the core 2, the coil 3 and the electroconductive layer 1*a* per unit length, which are shown in (a) of FIG. 5. The magnetomotive force generated by the magnetic flux φc passing through the core 2 is Vm, the permeance of the core 2 is Pc, and the permeance inside the electroconductive layer 1*a* is Pa_in. Further, the permeance in the electroconductive layer 1*a* itself of the fixing sleeve 1 is Ps, and the permeance outside the electroconductive layer 1*a* is Pa_out.

When Pc is large enough compared with Pa_in and Ps, it would be considered that the magnetic flux coming out of one end of the core 2 after passing through the inside of the core 2 returns to the other end of the core 2 after passing through either of φa_in, φs and φa_out. Therefore, the following formula (5) holds.

$$\varphi c = \varphi a_in + \varphi s + \varphi a_out \tag{5}$$

Further, φc, φa_in, φs and φa_out are represented by the following formulas (6) to (9), respectively.

$$\varphi c = Pc \times Vm \tag{6}$$

$$o = Ps \times Vm \tag{7}$$

$$\varphi a_in = Pa_in \times Vm \tag{8}$$

$$\varphi a_out = Pa_out \times Vm \tag{9}$$

Therefore, when the formulas (6) to (9) are substituted into the formula (5), Pa_out is represented by the following formula (10).

$$\begin{aligned} Pc \times Vm &= \text{Pa_in} \times Vm + Ps \times Vm + \text{Pa_out} \times Vm \\ &= (\text{Pa_in} + Ps + \text{Pa_out}) \times Vm \\ \therefore \text{Pa_out} &= Pc - \text{Pa_in} - Ps \end{aligned} \tag{10}$$

When the cross-sectional area of the core 2 is Sc, the cross-sectional area inside the electroconductive layer 1*a* is Sa_in, and the cross-sectional area of the electroconductive layer 1*a* itself is Ss, referring to (b) of FIG. 6, each of Pc, Pa_in, and Ps can be represented by the product of "(permeability)×(cross-sectional area)" as shown below. The unit is "H·m".

$$Pc = \mu 1 \times Sc = \mu 1 \times \pi (a1)^2 \tag{11}$$

$$\begin{aligned} \text{Pa_in} &= \mu O \times \text{Sa_in} \\ &= \mu 0 \times \pi \times ((a2)^2 - (a1)^2) \end{aligned} \tag{12}$$

$$Ps = \mu 2 \times Ss = \mu 2 \times \pi \times ((a3)^2 - (a2)^2) \tag{13}$$

When the formulas (11) to (13) are substituted into the formula (10), Pa_out is represented by the following formula (14).

$$\begin{aligned} \text{Pa_out} &= Pc - \text{Pa_in} - Ps \\ &= \mu 1 \times Sc - \mu 0 \times \text{Sa_in} - \mu 2 \times Ss \\ &= \pi \times \mu 1 \times (a1)^2 - \\ &\quad \pi \times \mu 0 \times ((a2)^2 - (a1)^2) - \\ &\quad \pi \times \mu 2 \times ((a3)^2 - (a2)^2) \end{aligned} \tag{14}$$

By using the above formula (14), Pa_out/Pc which is a proportion of the magnetic lines of force passing through the outside of the electroconductive layer 1*a* can be calculated.

In place of the permeance P, the magnetic reluctance R may also be used. In the case where the magnetic reluctance R is used, the magnetic reluctance R is simply the reciprocal of the permeance P, and therefore the magnetic reluctance R per unit length can be expressed by "1/((permeability)×(cross-sectional area)), and the unit is "1/(H·m)".

A result of specific calculation using parameters of the device in the Embodiment is shown in Table 1.

TABLE 1

| Item | U*1 | MC*2 | FG*3 | IEL*4 | EL*5 | OEL*6 |
|---|---|---|---|---|---|---|
| CSA*7 | $m^2$ | 1.5E−04 | 1.0E−04 | 2.0E−04 | 1.5E−06 | |
| RP*8 | | 1800 | 1 | 1 | 1 | |
| P*9 | H/m | 2.3E−03 | 1.3E−06 | 1.3E−06 | 1.3E−06 | |
| PPUL*10 | H · m | 3.5E−07 | 1.3E−10 | 2.5E−10 | 1.9E−12 | 3.5E−07 |
| MRPUL*11 | 1/(H/m) | 2.9E+06 | 8.0E+09 | 4.0E+09 | 5.3E+11 | 2.9E+06 |
| MFR*12 | % | 100.0 | 0.0 | 0.1 | 0.0 | 99.9 |

*1."U" is the unit.
*2."MC" is the magnetic core.
*3."FG" is the film guide.
*4."IEL" is the inside of the electroconductive layer.
*5."EL" is the electroconductive layer.
*6."OEL" is the outside of the electroconductive layer.
*7."CSA" is the cross-sectional area.
*8."RP" is the relative permeability.
*9."P" is the permeability.
*10."PPUL" is the permeance per unit length.
*11."MRPUL" is the magnetic reluctance per unit length.
*12."MFR" is the magnetic flux ratio.

The core 2 is formed of ferrite (relative permeability: 1800) and is 14 (mm) in diameter and 1.5×10-4 (m2) in cross-sectional area. The sleeve guide 6 is formed of PPS (polyphenylene sulfide) (relative permeability: 1.0) and is 1.0×10-4 (m2) in cross-sectional area. The electroconductive layer 1*a* is formed of aluminum (relative permeability: 1.0) and is 24 (mm) in diameter, 20 (μm) in thickness and 1.5×10-6 (m2) in cross-sectional area.

The cross-sectional area of the region between the electroconductive layer 1*a* and the core 2 is calculated by subtracting the cross-sectional area of the core 2 and the cross-sectional area of the sleeve guide 6 from the cross-sectional area of the hollow portion inside the electroconductive layer 1*a* of 24 mm in diameter. The electric layer 1*b* and the surface layer 1*c* are provided outside the electroconductive layer 1*a* and do not contribute to the heat generation. Accordingly, in a magnetic circuit model for calculating the permeance, the layers 1*b* and 1*c* can be regarded as air layers outside the electroconductive layer 1*a*, and therefore there is no need to add the layers into the calculation.

From Table 1, Pc, Pa_in and Ps are values shown below.

$$Pc=3.5\times10\text{-}7\ (\mathrm{H\cdot m})$$

$$Pa_\mathrm{in}=1.3\times10\text{-}10+2.5\times10\text{-}10\ (\mathrm{H\cdot m})$$

$$Ps=1.9\times10\text{-}12\ (\mathrm{H\cdot m})$$

From a formula (15) shown below, Pa_out/Pc can be calculated using these values.

$$Pa_\mathrm{out}/Pc=(Pc-Pa_\mathrm{in}-Ps)/Ps=0.999\ (99.9\%) \tag{15}$$

The core 2 is divided into a plurality of cores with respect to the longitudinal direction, and a spacing (gap) is provided between adjacent divided cores in some cases. In the case where this spacing is filled with the air or a material of which relative permeability can be regarded as 1.0 or of which relative permeability is considerably smaller than the relative permeability of the core 2, the magnetic reluctance R of the core 2 as a whole becomes large, so that the function of inducing the magnetic lines of force degrades.

A calculating method of the permeance of the core 2 divided in the plurality of cores described above becomes complicated. In the following, a calculating method of the permeance of a whole of the core 2 in the case where the core 2 is divided into the plurality of cores which are equidistantly arranged via the spacing or the sheet-like non-magnetic material will be described. In this case, the magnetic reluctance over a longitudinal full length is derived and then is divided by the longitudinal full length to obtain the magnetic reluctance per unit length, and thereafter there is a need to obtain the permeance per unit length using the reciprocal of the magnetic reluctance per unit length.

Figure 8:
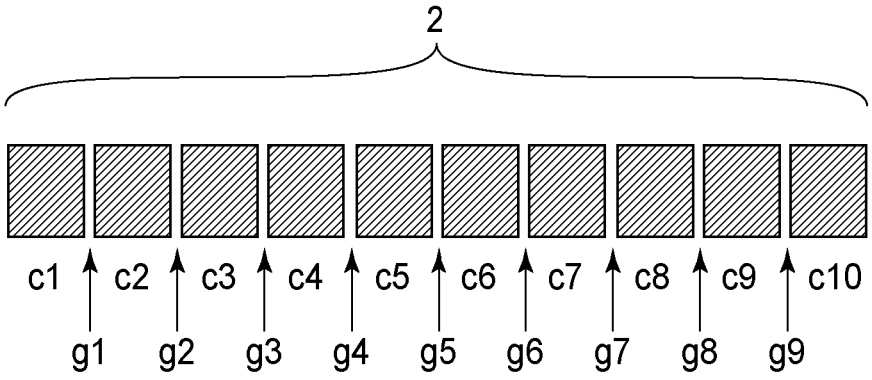
FIG. 8 is a schematic view showing magnetic cores and gaps.

First, a schematic view of the core 2 divided in the plurality of cores with respect to the longitudinal direction is shown in FIG. 8. Each of magnetic cores c1 to c10 is Sc in cross-sectional area, μc in permeability and Lc in width, and each of gaps g1 to g9 is Sg in cross-sectional area, μg in permeability and Lg in width. A total magnetic reluctance Rm_all of these magnetic cores with respect to the longitudinal direction is given by the following formula (16).

$$Rm_\mathrm{all}=(Rm_C1+Rm_c2+\ldots+Rm_C10)+(Rm_g1+Rm_g2+\ldots+Rm_g9) \tag{16}$$

In this case, the shape, the material and the gap width of the respective cores are uniform, and therefore when the sum of values of Rm_c is ΣRm_c, and the sum of values of Rm_g is ΣRm_g, the respective magnetic reluctances can be represented by the following formulas (17) to (19).

$$Rm_\mathrm{all}=(\Sigma Rm_c)+(\Sigma Rm_g) \tag{17}$$

$$Rm_c=Lc/(\mu c\times Sc) \tag{18}$$

$$Rm_g=Lg/(\mu g\times Sg) \tag{19}$$

By substituting the formulas (18) and (19) into the formula (17), the magnetic reluctance Rm_all over the longitudinal full length can be represented by the following formula (20).

$$\begin{aligned}\mathrm{Rm_all}&=\left(\sum \mathrm{Rm_c}\right)+\left(\sum \mathrm{Rm_g}\right)\\&=(\mathrm{Lc}/\mu\mathrm{c}\times\mathrm{Sc}))\times10+\\&\quad(\mathrm{Lg}/\mu\mathrm{g}+\mathrm{Sg}))\times9\end{aligned} \tag{20}$$

When the sum of values of Lc is ΣLc and the sum of values of Lg is ΣLg, the magnetic reluctance Rm per unit length is represented by the following formula (21).

$$Rm = \mathrm{Rm_all}/\left(\sum Lc + \sum Lg\right) = \mathrm{Rm_all}/(L \times 10 + Lg \times 9) \quad (21)$$

From the above, the permeance Pm per unit length is obtained from the following formula (22).

$$Pm = 1/Rm = \left(\sum Lc + \sum Lg\right)/\mathrm{Rm_all} = \left(\sum Lc + \sum Lg\right)/\left[\left\{\sum Lc/(\mu c + Sc)\right\} + \left\{\sum Lg/(\mu g + Sg)\right\}\right] \quad (22)$$

An increase in gap Lg leads to an increase in magnetic reluctance (i.e., a lowering in permeance) of the core 2. When the fixing device A in the Embodiment is constituted, on a heat generation principle, it is desirable that the core 2 is designed so as to have a small magnetic reluctance (i.e., a large permeance), and therefore it is not so desirable that the gap is provided. However, in order to prevent breakage of the core 2, the gap is provided by dividing the core 2 into a plurality of cores in some cases.

As described above, the proportion of the magnetic lines of force passing through the outside route can be represented using the permeance or the magnetic reluctance.

3-4) Conversion Efficiency of Electric Power Necessary for Fixing Device

Next, the conversion efficiency of the electric power necessary for the fixing device A in this embodiment will be described. For example, in the case where the conversion efficiency of the electric power is 80%, the remaining 20% of the electric power is converted into thermal energy by the coil, the core and the like, other than the electroconductive layer, and then is consumed. In the case in which the electric power conversion efficiency is low, members that should not generate heat, such as the core and the coil generate heat, so that there is a need to take measures to cool the members in some cases.

Figure 9:
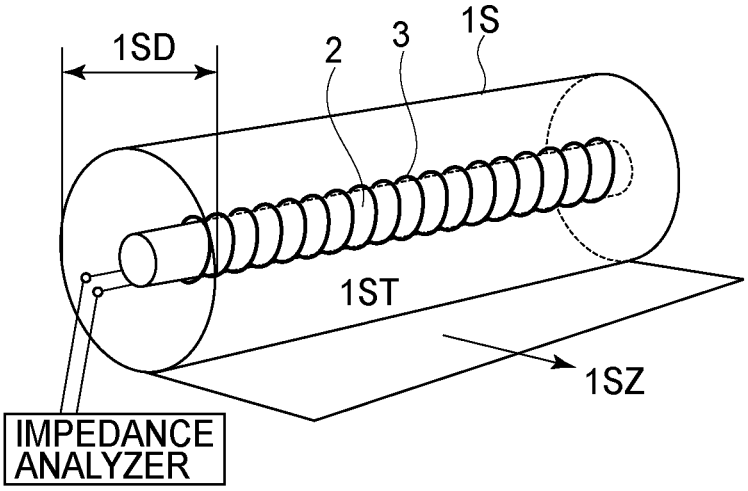
FIG. 9 is a perspective view of an experimental device used in a measuring experiment of electric power conversion efficiency.

Therefore, the electric power conversion efficiency is evaluated by changing the proportion of the magnetic flux passing through the outside route of the electroconductive layer 1*a*. FIG. 9 is a schematic view showing an experimental device used in a measurement test of the electric power conversion efficiency. A metal sheet 1S is an aluminum-made sheet of 230 mm in width, 600 mm in length and 20 μm in thickness. This metal sheet 1S is rolled up in a cylindrical shape so as to enclose the core 2 and the coil 3, and is electrically conducted at a portion 1ST to prepare an electroconductive layer 1*a*.

The core 2 is ferrite of 1800 in relative permeability and 500 mT in saturation flux density, and has a cylindrical shape of 26 mm2 in cross-sectional area and 230 mm in length. The core 2 is disposed substantially at a central (axis) portion of the cylinder of the aluminum sheet 1S by an unshown fixing means. Around the core 2, the coil 3 is helically wound 25 times in winding number. When an end portion of the metal sheet 1S is pulled in an arrow 1SZ direction, a diameter 1SD of the electroconductive layer 1*a* can be adjusted in a range of 18 mm to 191 mm.

Figure 10:
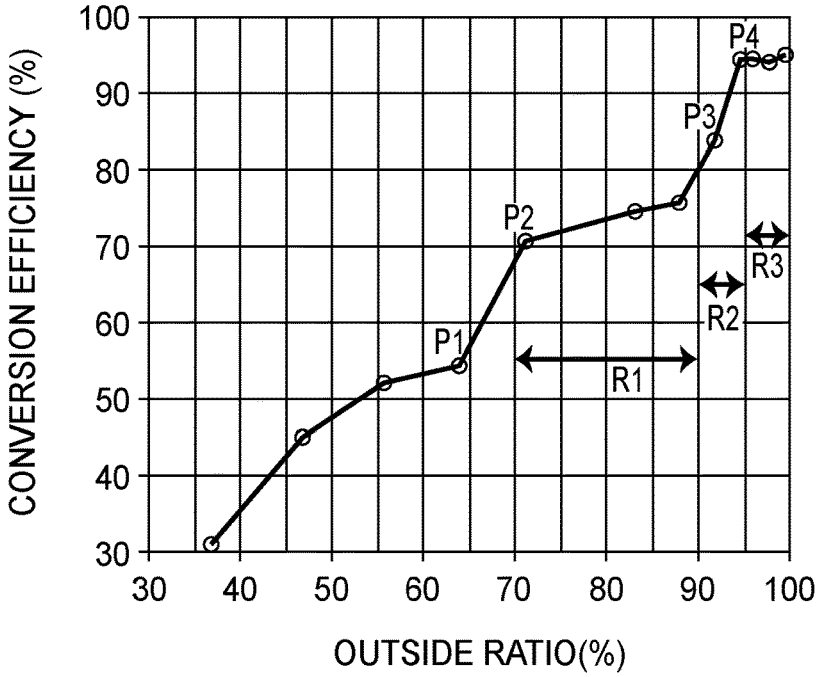
FIG. 10 is a graph showing a relationship between a ratio of cylindrical rotatable member external magnetic flux and conversion efficiency.

FIG. 10 is a graph in which the abscissa represents a ratio (%) of the magnetic flux passing through the outside route of the electroconductive layer 1*a*, and the ordinate represents the electric power conversion efficiency (%) at a frequency of 21 kHz. In the graph of FIG. 10, the electric power conversion efficiency abruptly increases from a plot P1 and then exceeds 70%, and is maintained at 70% or more in a range R1 indicated by a double-pointed arrow. In the neighborhood of P3, the electric power conversion efficiency abruptly increases again and exceeds 80% in a range R2. In a range R3 from P4, the electric power conversion efficiency is stable at a high value of 94% or more. The reason why the electric power conversion efficiency abruptly increases is that the circumferential current starts to pass through the electroconductive layer 1*a* efficiently.

Table 2 below shows a result of evaluation of constitutions, corresponding to P1 to P4 in FIG. 10, actually designed as fixing devices.

TABLE 2

| Plot | Range | D*1 (mm) | P*2 (%) | CE*3 (%) | ER*4 |
|---|---|---|---|---|---|
| P1 | — | 143.2 | 64.0 | 54.4 | IEP*5 |
| P2 | R1 | 127.3 | 71.2 | 70.8 | CM*6 |
| P3 | R2 | 63.7 | 91.7 | 83.9 | HRD*7 |
| P4 | R3 | 47.7 | 94.7 | 94.7 | OPTIMUM*8 |

*1"D" represents the electroconductive layer diameter.
*2"P" represents the proportion of the magnetic flux passing through the outside route of the electroconductive layer.
*3"CE" represents the electric power conversion efficiency.
*4"ER" represents an evaluation result in the case where the fixing device has a high specification.
*5"IEP" is that there is a possibility that the electric power becomes insufficient.
*6"CM" is that it is desirable that a cooling means is provided.
*7"HRD" is that it is desirable that heat-resistant design is optimized.
*8"OPTIMUM" is that the constitution is optimum for the flexible film.

(Fixing Device P1)

In this constitution, the cross-sectional area of the core 2 is 26.5 $mm^2$ (5.75 mm×4.5 mm), the diameter of the electroconductive layer 1*a* is 143.2 mm, and the proportion of the magnetic flux passing through the outside route is 64%. The electric power conversion efficiency of this device, obtained by the impedance analyzer, was 54.4%. The electric power conversion efficiency is a parameter indicating a degree (proportion) of electric power, contributing to heat generation of the electroconductive layer 1*a*, of the electric power supplied to the fixing device. Accordingly, even when the constitution is designed as the fixing device capable of outputting 1000 W as a maximum, about 450 W is lost, and the loss results in heat generation of the coil 3 and the core 2.

In the case of this constitution, during a period of temperature rise, the coil temperature exceeds 200° C. in some cases, even when 1000 W is supplied only for several seconds. Considering a case in which a heat-resistant temperature of an insulating member of the coil 3 is high, for example, 200° C., and a Courie point of the ferrite magnetic core 2 is about 200° C. to about 250° C., at the loss of 45%, it becomes difficult to maintain the temperature of a member, such as the coil 3, at the heat-resistant temperature or less. Further, when the temperature of the core 2 exceeds the Courie point, the coil inductance abruptly lowers, so that a load fluctuates.

About 45% of the electric power supplied to the fixing device is not used for heat generation of the electroconductive layer 1*a*, and therefore, in order to supply the electric power of 900 W (estimated as 90% of 1000 W) to the electroconductive layer 1*a*, there is a need to supply electric power of about 1636 W. This means that a power source is such that 16.36 A is consumed when 100 V is inputted. Therefore, there is a possibility that the consumed current exceeds an allowable current capable of being supplied from an attachment plug of a commercial AC power source.

Accordingly, in the fixing device P1 of 54.4% in electric power conversion efficiency, there is a possibility that the electric power to be supplied to the fixing device is insufficient.

(Fixing Device P2)

In this constitution, the cross-sectional area of the core 2 is the same as the cross-sectional area in P1, the diameter of the electroconductive layer 1*a* is 127.3 mm, and the proportion of the magnetic flux passing through the outside route is 71.2%. The electric power conversion efficiency of this device, obtained by the impedance analyzer was 70.8%. In some cases, temperature rise of the coil 3 and the core 2 becomes problematic depending on the specification of the fixing device.

When the fixing device of this constitution is constituted as a device having a high specification, such as that used in a printing operation of 60 sheets/min, a rotational speed of the electroconductive layer 1*a* is 330 mm/sec, so that it is desirable to maintain the temperature of the electroconductive layer 1*a* at 180° C. When the temperature of the electroconductive layer 1*a* is intended to be maintained at 180° C., the temperature of the magnetic core exceeds 240° C. in 20 sec in some cases.

The Courie temperature (point) of ferrite used as the core 2 is ordinarily about 200° C. to about 250° C., and therefore, in some cases, the temperature of ferrite exceeds the Courie temperature, and the permeability of the core 2 abruptly decreases, and thus the magnetic lines of force cannot be properly induced by the core 2. As a result, it becomes difficult to induce the circumferential current to cause the electroconductive layer 1*a* to generate heat in some cases.

Accordingly, when the fixing device in which the proportion of the magnetic flux passing through the outside route is in the range R1, is constituted as the above-described high-specification device, in order to lower the temperature of the ferrite core, it is desirable that a cooling means is provided. As the cooling means, it is possible to use an air-cooling fan, water cooling, a cooling wheel, a radiation fin, heat pipe, Peltier element or the like. In this constitution, there is no need to provide the cooling means in the case in which the high specification is not required to such extent.

(Fixing Device P3)

This constitution is the case where the cross-sectional area of the core 2 is the same as the cross-sectional area in P1, and the diameter of the electroconductive layer 1*a* is 63.7 mm. The electric power conversion efficiency of this device, obtained by the impedance analyzer was 83.9%. Although the heat quantity is steadily-generated in the core 2, the coil 3 and the like, a level thereof is not a level such that the cooling means is required.

When the fixing device of this constitution is constituted as a device having a high specification, such as that used in a printing operation of 60 sheets/min, a rotational speed of the electroconductive layer 1*a* is 330 mm/sec. The case where the surface temperature of the electroconductive layer 1*a* is maintained at 180° C. exists, but the temperature of the magnetic core (ferrite) does not increase to 220° C. or more. Accordingly, in this constitution, in the case in which the fixing device is constituted as the above-described high-specification device, it is desirable that ferrite having the Courie temperature of 220° C. or more is used.

As described above, in the case in which the fixing device in which the proportion of the magnetic flux passing through the outside route is in the range R2, is used as the high-specification device, it is desirable that heat-resistant design of ferrite or the like is optimized. On the other hand, in the case in which the high specification is not required as the fixing device, such a heat-resistant design is not needed.

(Fixing Device P4)

This constitution is the case in which the cross-sectional area of the core 2 is the same as the cross-sectional area in P1, and the diameter of the cylinder is 47.7 mm. The electric power conversion efficiency of this device, obtained by the impedance analyzer was 94.7%.

When the fixing device of this constitution is constituted as a device having a high specification, such as that used in a printing operation of 60 sheets/min, (rotational speed of electroconductive layer: 330 mm/sec), even in the case in which the surface temperature of the electroconductive layer 1*a* is maintained at 180° C., the temperatures of the coil 3, the core 2 and the like do not reach 180° C. or more. Accordingly, the cooling means for cooling the core 2, the coil 3 and the like, and particular heat-resistant design are not needed.

As described above, in the range R3 in which the proportion of the magnetic flux passing through the outside route is 94.7% or more, the electric power conversion efficiency is 94.7% or more, and thus is sufficiently high. Therefore, even when the fixing device of this constitution is used as a further high-specification fixing device, the cooling means is not needed.

Further, in the range R3 in which the electric power conversion efficiency is stable at high values, even when an amount of the magnetic flux per unit time, passing through the inside of the electroconductive layer 1*a*, somewhat fluctuates, depending on a fluctuation in positional relationship between the electroconductive layer 1*a* and the core 2, a fluctuation amount of the electric power conversion efficiency is small. Therefore, the heat generation amount of the electroconductive layer 1*a* is stabilized. As in the case of the fixing sleeve 1, in the fixing device in which a distance between the electroconductive layer 1*a* and the core 2 is liable to fluctuate, use of the range R3 in which the electric power conversion efficiency is stable at the high values has a significant advantage.

As described above, it is understood that in the fixing device in this embodiment, the proportion of the magnetic flux passing through the outside route is required to be 70% or more in order to satisfy at least the necessary electric power conversion.

3-5) Relational Expression of Permeance or Magnetic Reluctance to be Satisfied by Fixing Device The requirement that the proportion of the magnetic flux passing through the outside route of the electroconductive layer 1*a* is 70% or more is equivalent to the requirement that the sum of the permeance of the electroconductive layer 1*a* and the permeance of the induction (region between the electroconductive layer and the magnetic core) of the electroconductive layer 1*a* is 30% or less of the permeance of the core 2.

Accordingly, one of features of the constitution in this embodiment is that when the permeance of the core 2 is Pc, the permeance of the inside of the electroconductive layer 1*a* is Pa, and the permeance of the electroconductive layer 1*a* is Ps, the following formula (23) is satisfied.

$$0.30 \times Pc \geq Ps + Pa \tag{23}$$

When the relational expression of the permeance is replaced with a relational expression of the magnetic reluctance, the following formula (24) is satisfied.

$$0.30 \times P_c \geq P_s + P_a \tag{24}$$

$$0.30 \times \frac{1}{Rc} \geq \frac{1}{R_s} + \frac{1}{R_a}$$

$$0.30 \times \frac{1}{Rc} \geq \frac{1}{R_{sa}}$$

$$0.30 \times R_{sa} \geq Rc$$

However, a combined magnetic reluctance Rsa of Rs and Ra is calculated by the following formula (25).

$$\frac{1}{R_{sa}} = \frac{1}{R_s} + \frac{1}{R_a} \tag{25}$$

$$R_{sa} = \frac{R_a \times R_s}{R_a + R_s}$$

Rc: magnetic reluctance of the magnetic core

Rs: magnetic reluctance of the electroconductive layer

Ra: magnetic reluctance of the region between the electroconductive layer and the magnetic core Rsa: combined magnetic reluctance of Rs and Ra The above-described relational expression of the permeance or the magnetic reluctance may desirably be satisfied, in a cross-section perpendicular to the generatrix direction of the fixing sleeve 1 as the cylindrical rotatable member, over a whole of a maximum feeding region of the recording material P (maximum sheet-passing region width WP) of the fixing device.

Similarly, in the fixing device in this embodiment, the proportion of the magnetic flux passing through the outside route of the electroconductive layer 1*a* is 90% or more in the range R2, and therefore, the relational expression of the permeance is represented by the following formula (26).

$$0.10 \times P_c \geq P_s + P_a \tag{26}$$

When the relational expression of the permeance is converted into a relational expression of the magnetic reluctance, the following formula (27) is satisfied.

$$0.10 \times P_c \geq P_s + P_a$$

$$0.10 \times R_{sa} \geq R_c \tag{27}$$

Further, in the fixing device in this embodiment, the proportion of the magnetic flux passing through the outside route is 94% or more in the range R3, and therefore, the relational expression of the permeance is represented by the following formula (28).

$$0.06 \times P_c \geq P_s + P_a \tag{28}$$

When the relational expression of the permeance is converted into a relational expression of the magnetic reluctance, the following formula (29) is satisfied.

$$0.06 \times P_c \geq P_s + P_a$$

$$0.06 \times R_{sa} \geq R_c \tag{29}$$

In the above formulas, the relational expressions of the permeance and the magnetic reluctance in the fixing device, in which the member or the like in the maximum image region (width) of the fixing device has a uniform cross-sectional structure, were shown. In the following, the fixing device in which the member or the like constituting the fixing device has a non-uniform cross-sectional structure with respect to the longitudinal direction will be described.

Figure 11:
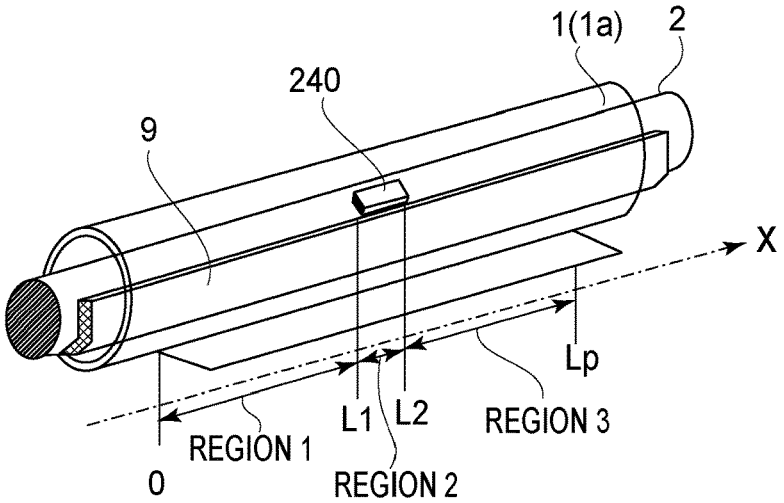
FIG. 11 is a perspective view of the fixing device having a non-uniform cross-sectional constitution with respect to a longitudinal direction.

In FIG. 11, the temperature detecting member (thermistor) 240 is provided inside (i.e., in a region between the core 2 and the electroconductive layer 1*a*) of the electroconductive layer 1*a*. Other constitutions are the same as those in FIG. 1, so that the fixing device includes the fixing sleeve 1 including the electroconductive layer 1*a*, and includes the core 2 and the sleeve guide 6.

When the longitudinal direction of the core 2 is an X-axis direction, the maximum image forming region is a range from 0 to Lp on the X-axis. For example, in the case of the image forming apparatus in which the maximum feeding region of the recording material P (maximum sheet-passing region width WP) is the LTR size of 215.9 mm, Lp is 215.9 mm may only be satisfied.

The temperature detecting member 240 is constituted by a non-magnetic material of 1 in relative permeability, and is 5 mm×5 mm in cross-sectional area with respect to a direction perpendicular to the X-axis and 10 mm in length with respect to a direction parallel to the X-axis. The temperature detecting member 240 is disposed at a position from L1 (102.95 mm) to L2 (112.95 mm) on the X-axis. Here, on the X-axis, a region from 0 to L1 is referred to as region 1, a region from L1 to L2 where the temperature detecting member 240 exists is referred to as region 2, and a region from L2 to Lp is referred to as region 3.

Figure 12:
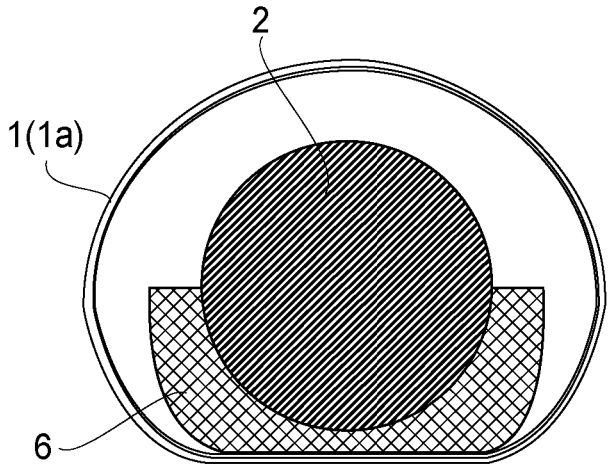
In FIG. 12, (a) and (b) are sectional views of the fixing device having the non-uniform cross-sectional constitution with respect to the longitudinal direction.
Figure 12:
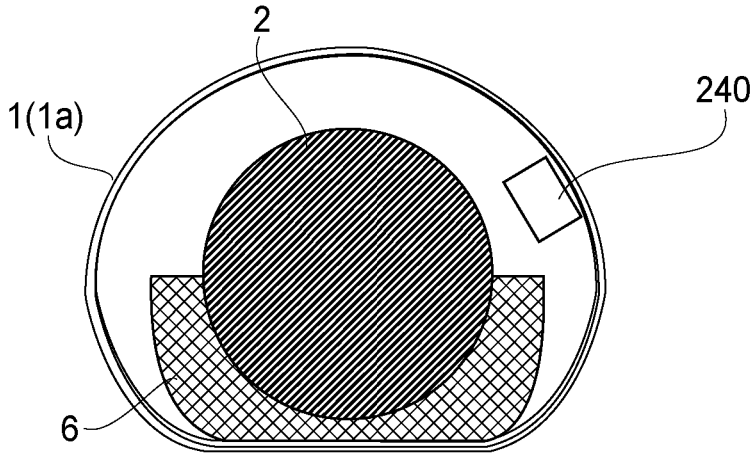

The cross-sectional structure in the region 1 is shown in (a) of FIG. 12, and the cross-sectional structure in the region 2 is shown in (b) of FIG. 12. As shown in (b) of FIG. 12, the temperature detecting member 240 is incorporated in the fixing sleeve 1, and therefore is an object to be subjected to calculation of the magnetic reluctance. In order to strictly make the magnetic reluctance calculation, the "magnetic reluctance per unit length" in each of the regions 1, 2 and 3 is obtained separately, and integration calculation is made depending on the length of each region, and then the combined magnetic reluctance is obtained by adding up the integral values.

First, the magnetic reluctance per unit length of each of components (parts) in the region 1 or 3 is shown in Table 3.

TABLE 3

| Item | U*1 | MC*2 | SG*3 | IEL*4 | EL*5 |
|---|---|---|---|---|---|
| CSA*6 | $m^2$ | 1.5E−04 | 1.0E−04 | 2.0E−04 | 1.5E−06 |
| RP*7 | | 1800 | 1 | 1 | 1 |
| P*8 | H/m | 2.3E−03 | 1.3E−06 | 1.3E−06 | 1.3E−06 |
| PPUL*9 | H · m | 3.5E−07 | 1.3E−10 | 2.5E−10 | 1.9E−12 |
| MRPUL*10 | 1/(H · m) | 2.9E+06 | 8.0E+09 | 4.0E+09 | 5.3E+11 |

*1"U" is the unit.
*2"MC" is the magnetic core.
*3"SG" is the sleeve guide.
*4"IEL" is the inside of the electroconductive layer. x
*5"EL" is the electroconductive layer. electroconductive layer.
*6"CSA" is the cross-sectional area.
*7"RP" is the relative permeability.
*8"P" is the permeability.
*9"PPUL" is the permeance per unit length.
*10"MRPUL" is the magnetic reluctance per unit length.

In the region 1, a magnetic reluctance per unit length (rc1) of the magnetic core is as follows.

$$rc1 = 2.9 \times 10^6 \ (1/(H \cdot m))$$

In the region between the electroconductive layer 1*a* and the core 2, a magnetic reluctance per unit length (ra) is a combined magnetic reluctance of a magnetic reluctance per unit length (rf) of the sleeve guide 6 and a magnetic reluctance per unit length (rair) of the inside of the electroconductive layer 1*a*. Accordingly, the magnetic reluctance ra can be calculated using the following formula (30).

$$\frac{1}{r_a} = \frac{1}{r_f} + \frac{1}{r_{air}} \tag{30}$$

As a result of the calculation, a magnetic reluctance $r_{r1}$ in the region 1 and a magnetic reluctance $r_{s1}$ in the region 1 are follows.

$$r_{a1}=2.7\times10^{9}\ (1/(\mathrm{H\cdot m}))$$

$$r_{s1}=5.3\times10^{11}\ (1/(\mathrm{H\cdot m}))$$

Further, the region 3 is equal in length to the region 1, and therefore magnetic reluctance values in the region 3 are as follows.

$$r_{c3}=2.9\times10^{6}\ (1/(\mathrm{H\cdot m}))$$

$$r_{a3}=2.7\times10^{9}\ (1/(\mathrm{H\cdot m}))$$

$$r_{s3}=5.3\times10^{11}\ (1/(\mathrm{H\cdot m}))$$

Next, the magnetic reluctance per unit length of each of components (parts) in the region 2 is shown in Table 4.

TABLE 4

| Item | U*1 | MC*2 | SG*3 | T*4 | IEL*5 | EL*6 |
|---|---|---|---|---|---|---|
| CSA*7 | $m^2$ | 1.5E−04 | 1.0E−04 | 2.5E−05 | 1.72E−04 | 1.5E−06 |
| RP*8 | | 1800 | 1 | 1 | 1 | 1 |
| P*9 | H/m | 2.3E−03 | 1.3E−06 | 1.3E−06 | 1.3E−06 | 1.3E−06 |
| PPUL*10 | H · m | 3.5E−07 | 1.3E−10 | 3.1E−11 | 2.2E−10 | 1.9E−12 |
| MRPUL*11 | 1/(H/m) | 2.9E+06 | 8.0E+09 | 3.2E+10 | 4.6E+09 | 5.3E+11 |

*1"U" is the unit.
*2"MC" is the magnetic core.
*3"SG" is the sleeve guide.
*4"T" is the thermistor.
*6"EL" is the electroconductive layer.
*7"CSA" is the cross-sectional area.
*8"RP" is the relative permeability.
*9"P" is the permeability.
*10"PPUL" is the permeance per unit length.
*11"MRPUL" is the magnetic reluctance per unit length.

In the region 2, a magnetic reluctance per unit length (rc2) of the magnetic core is as follows.

$$rc2=2.9\times106\ (1/(\mathrm{H\cdot m}))$$

In the region between the electroconductive layer 1*a* and the core 1, a magnetic reluctance per unit length (ra) is a combined magnetic reluctance of a magnetic reluctance per unit length (rf) of the fixing sleeve guide, a magnetic reluctance per unit length (rt) of the thermistor and a magnetic reluctance per unit length (rair) of the inside air of the electroconductive layer. Accordingly, the magnetic reluctance ra can be calculated using the following formula (31).

$$\frac{1}{r_a} = \frac{1}{r_t} + \frac{1}{r_f} + \frac{1}{r_{air}} \tag{31}$$

As a result of the calculation, a magnetic reluctance per unit length ($r_{a2}$) in the region 1 and a magnetic reluctance per unit length ($r_{s2}$) in the region 2 are follows.

$$r_{a2}=2.7\times10^{9}\ (1/(\mathrm{H\cdot m}))$$

$$r_{s2}=5.3\times10^{11}\ (1/(\mathrm{H\cdot m}))$$

The region 3 is equal in calculating method to the region 1, and therefore the calculating method in the region 3 will be omitted.

The reason why $r_{a1}=r_{a2}=r_{a3}$ is satisfied with respect to the magnetic reluctance per unit length ($r_a$) of the region between the electroconductive layer 1*a* and the core 2 will be described. In the magnetic reluctance calculation in the region 2, the cross-sectional area of the thermistor 240 is increased, and the cross-sectional area of the inside air of the electroconductive layer 1*a* is decreased. However, the relative permeability of both of the thermistor 240 and the electroconductive layer 1*a* is 1, and therefore, the magnetic reluctance is the same irrespective of the presence or absence of the thermistor 240 after all.

That is, in the case in which only the non-magnetic material is disposed in the region between the electroconductive layer 1*a* and the core 2, calculation accuracy is sufficient even when the calculation of the magnetic reluctance is similarly treated as in the case of the inside air. This is because in the case of the non-magnetic material, the relative permeability becomes a value almost close to 1. On the other hand, in the case of the magnetic material (such as nickel, iron or silicon steel), the magnetic reluctance in the region where the magnetic material exists may preferably be calculated separately from the material in another region.

Integration of magnetic reluctance R (A/Wb(1/h)) as the combined magnetic reluctance with respect to the generatrix direction of the electroconductive layer 1*a* can be calculated using magnetic reluctance values r1, r2 and r3 (1/(H·m)) in the respective regions as shown in the following formula (32).

$$R\int_0^{L1} r1\,d1 + \int_{L1}^{L2} r2\,d1 + \int_{L2}^{LP} r3\,d1 = r1(L1-0) + r2(L2-L1) + r3(LP-L2) \tag{32}$$

Accordingly, a magnetic reluctance Rc (H) of the core in a section from one end to the other end in the maximum recording material feeding region can be calculated as shown in the following formula (33).

$$R_c\int_0^{L1} r_c^1\,d1 + \int_{L1}^{L2} r_c^2\,d1 + \int_{L2}^{LP} r_c^3\,d1 = r_c^1(L1-0) + r_c^2(L2-L1) + r_c^3(LP-L2) \tag{33}$$

Further, a combined magnetic reluctance Ra (H) of the region, between the electroconductive layer and the core, in the section from one end to the other end in the maximum recording material feeding region can be calculated as shown in the following formula (34).

$$R_a = \int_0^{L1} r_a 1 d1 + \int_{L1}^{L2} r_a 2 d1 + \int_{L2}^{Lp} r_a 3 d1 = r_a 1(L1 - 0) + r_a 2(L2 - L1) + r_a 3(LP - L2) \quad (34)$$

Further, a combined magnetic reluctance Rs (H) of the electroconductive layer in the section from one end to the other end in the maximum recording material feeding region can be calculated as shown in the following formula (35).

$$R_s = \int_0^{L1} r_s 1 d1 + \int_{L1}^{L2} r_s 2 d1 + \int_{L2}^{Lp} r_s 3 d1 = r_s 1(L1 - 0) + r_s 2(L2 - L1) + r_s 3(LP - L2) \quad (35)$$

A calculation result in each of the regions 1, 2 and 3 is shown in Table 5.

TABLE 5

| Item | Region 1 | Region 2 | Region 3 | MCR*1 |
|---|---|---|---|---|
| ISP*2 | 0 | 102.95 | 112.95 | |
| IEP*3 | 102.95 | 112.95 | 215.9 | |
| D*4 | 102.95 | 10 | 102.95 | |
| pc*5 | 3.5E−07 | 3.5E−07 | 3.5E−07 | |
| rc*6 | 2.9E+06 | 2.9E+06 | 2.9E+06 | |
| Irc*7 | 3.0E+08 | 2.9E+07 | 3.0E+08 | 6.2E+08 |
| pm*8 | 3.7E−10 | 3.7E−10 | 3.7E−10 | |
| rm*9 | 2.7E+09 | 2.7E+09 | 2.7E+09 | |
| Irm*10 | 2.8E+11 | 2.7E+10 | 2.8E+11 | 5.8E+11 |
| ps*11 | 1.9E−12 | 1.9E−12 | 1.9E−12 | |
| rs*12 | 5.3E+11 | 5.3E+11 | 5.3E+11 | |
| Irs*13 | 5.4E+13 | 5.3E+12 | 5.4E+13 | 1.1E+14 |

*1"CMR" is the combined magnetic reluctance.
*2"ISP" is an integration start point (mm).
*3"IEP" is an integration end point (mm).
*4"D" is the distance (mm).
*5"pc" is the permeance per unit length (H · m).
*6"rc" is the magnetic reluctance per unit length (1/(H · m)).
*7"Irc" is integration of the magnetic reluctance rm (A/Wb(1/H)).
*8"pm" is the permeance per unit length (H · m).
*9"rm" is the magnetic reluctance per unit length (1/(H · m)).
*10"Irm" is integration of the magnetic reluctance rm (A/Wb(1/H)).
*11"ps" is the permeance per unit length (H · m).
*12"rs" is the magnetic reluctance per unit length (1/(H · m)).
*13"Irs" is integration of the magnetic reluctance rm (A/Wb(1/H)).

From Table 10, Rc, Ra and Rs are follows.

$Rc = 6.2 \times 10^8$ (1/H)

$Ra = 5.8 \times 10^{11}$ (1/H)

$Rs = 1.1 \times 10^{14}$ (1/H)

The combined magnetic reluctance Rsa of Rs and Ra can be calculated by the following formula (36).

$$\frac{1}{R_{sa}} = \frac{1}{R_s} + \frac{1}{R_a} \quad (36)$$

$$R_{sa} = \frac{R_a \times R_s}{R_a + R_s}$$

From the above calculation, Rsa=5.8×1011 (1/H) holds, thus satisfying the following formula (37).

$$0.30 \times R_{sa} \geq R_c \quad (37)$$

As described above, in the case of the fixing device in which a non-uniform cross-sectional shape is formed with respect to the generatrix direction of the electroconductive layer, the region is divided into a plurality of regions, and the magnetic reluctance is calculated for each of the divided regions, and finally, the combined permeance or magnetic reluctance may be calculated from the respective magnetic reluctance values. However, in the case where the member to be subjected to the calculation is the non-magnetic material, the permeability is substantially equal to the permeability of the air, and therefore the calculation may be made by regarding the member as the air.

Next, the component (part) to be included in the above calculation will be described. With respect to the component which is disposed between the electroconductive layer and the core and at least a part of which is placed in the maximum recording material feeding region (0 to Lp), it is desirable that the permeance or the magnetic reluctance thereof is calculated.

On the other hand, with respect to the component (member) disposed outside the electroconductive layer, there is no need to calculate the permeance or the magnetic reluctance thereof. This is because, as described above, based on Faraday's law, the induced electromotive force is proportional to a change with time of the magnetic flux vertically passing through the circuit, and therefore, is irrespective of the magnetic flux outside the electroconductive layer. Further, the member disposed out of the maximum recording material feeding region with respect to the generatrix direction of the electroconductive layer has no influence on the heat generation of the electroconductive layer, and therefore there is no need to make the calculation.

Figure 13:
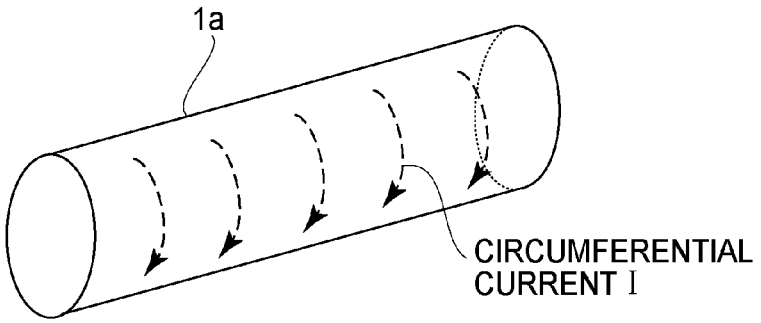
In FIG. 13, (a) is a perspective view of an electric conductive layer having no cut-away portion, and (b) is an equivalent circuit diagram, respectively, showing the case in which a circumferential current (circulating current) flows through the electroconductive layer having no cut-away portion.
Figure 13:
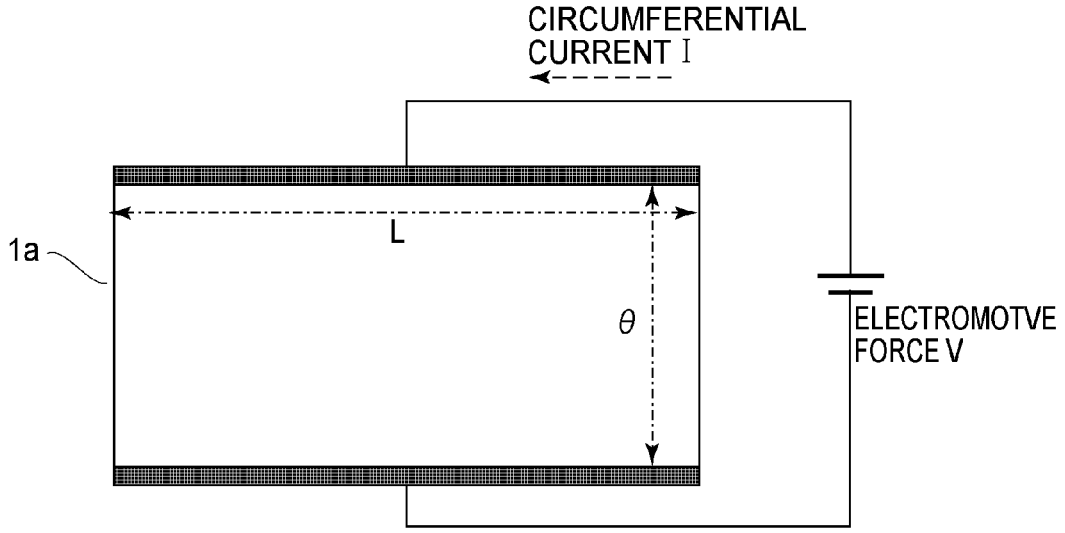

3-6) Equivalent Circuit of Electroconductive Layer of Cylindrical Rotatable Member In FIG. 13, (a) is a perspective view of the electroconductive layer 1*a* of the cylindrical rotatable member (fixing sleeve) 1 in the case where the electroconductive layer 1*a* is not provided with cut-away (slit) portions 20. According to a constitution of this embodiment, the electromotive force with respect to the circumferential direction is applied to the electroconductive layer 1*a* of the cylindrical rotatable member 1, whereby a circumferential current (circulating current) I flows in a direction indicated by an arrow in the figure. As an equivalent circuit of (a) of FIG. 13, a circuit in which the electroconductive layer 1*a* of the cylindrical rotatable member 1 is cut away and a DC voltage is applied to both ends (terminals) is shown in (b) of FIG. 13. When a length of the electroconductive layer 1*a* with respect to the generatrix direction is L, a circumferential length of the electroconductive layer 1*a* with respect to the circumferential direction is θ, a thickness of the electroconductive layer 1*a* is d and an electrical resistivity of the electroconductive layer 1*a* is p, a total resistance R of the electroconductive layer 1*a* is represented by the following formula (38).

$$R = \frac{\delta}{Ld}\rho \quad (38)$$

Therefore, in the case where the electromotive force V is applied to the electroconductive layer 1*a* of (b) of FIG. 13, an entire heat generation amount W of the electroconductive layer 1*a* and a heat generation amount per unit volume ω of the electroconductive layer 1*a* can be calculated by the following formulas (39) and (40), respectively.

$$W = \frac{v^2}{R} = \frac{Ld}{\delta}\frac{v^2}{\rho} \tag{39}$$

$$\omega = \frac{w}{\theta Ld} = \frac{1}{\delta^2}\frac{v^2}{\rho} \tag{40}$$

(4) Heat Generation Principle of Case where Electroconductive Layer of Fixing Sleeve is Provided with Cut-Away Portions A heat generation principle in this embodiment in the case where the electroconductive layer 1*a* of the fixing sleeve 1 is provided with the cut-away portions 20 will be described.

4-1) Principle of Suppression of Excessive Heat Generation by Cut-Away Portion

In the fixing device of a type in which the electroconductive layer is heated by the circumferential current flowing through the electroconductive layer as in this embodiment, the case where the electroconductive layer of the cylindrical rotatable member is provided with the cut-away portion and the case where the electroconductive layer of the cylindrical rotatable member is not provided with the cut-away portion are compared with each other and the principle of suppression of the excessive heat generation by the presence of the cut-away portion will be described by an electric network calculation.

Figure 14:
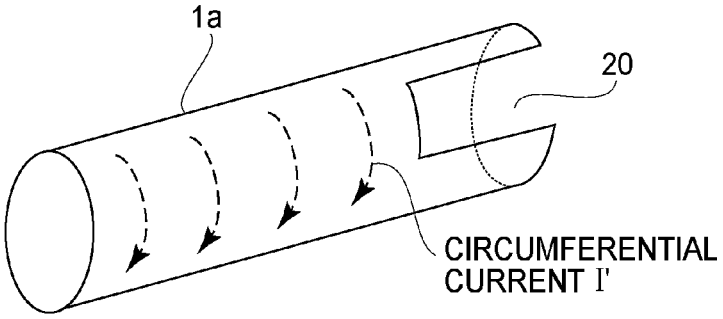
In FIG. 14, (a) is a perspective view of an electric conductive layer having a cut-away portion, and (b) is an equivalent circuit diagram, respectively, showing the case in which the circumferential current flows through the electroconductive layer having the cut-away portion.
Figure 14:
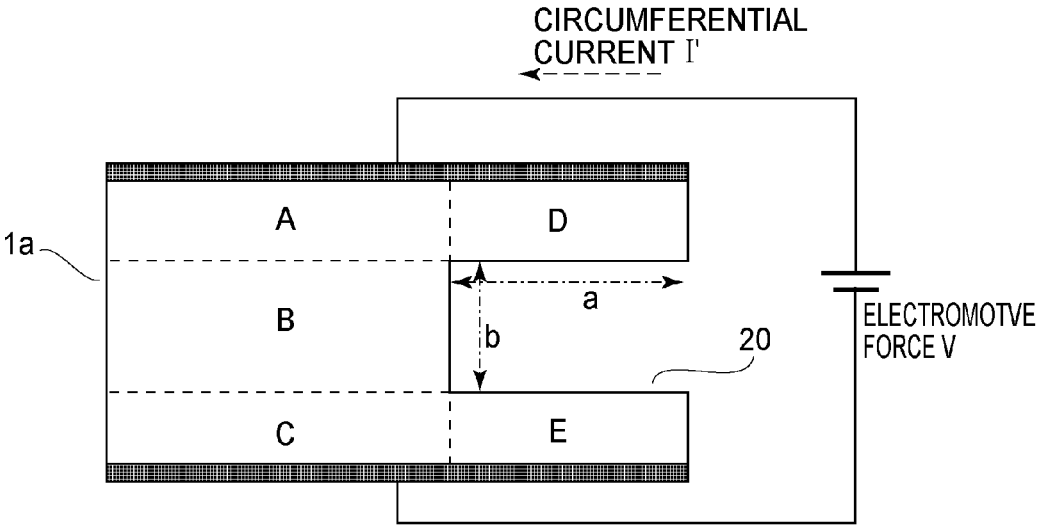

In FIG. 14, (a) is a perspective view showing the case where the electroconductive layer 1*a* of the cylindrical rotatable member 1 shown in (a) of FIG. 13 is provided with the cut-away portion 20. In this state, when the electromotive force V is applied to the electroconductive layer 1*a* with respect to the circumferential direction, a circumferential current I' flows in a direction indicated by an arrow in the figure. As an equivalent circuit of (a) of FIG. 14, a circuit in which the electroconductive layer 1*a* of the cylindrical rotatable member 1 is partly cutaway and a DC voltage is applied to both ends (terminals) is shown in (b) of FIG. 14.

Figure 15:
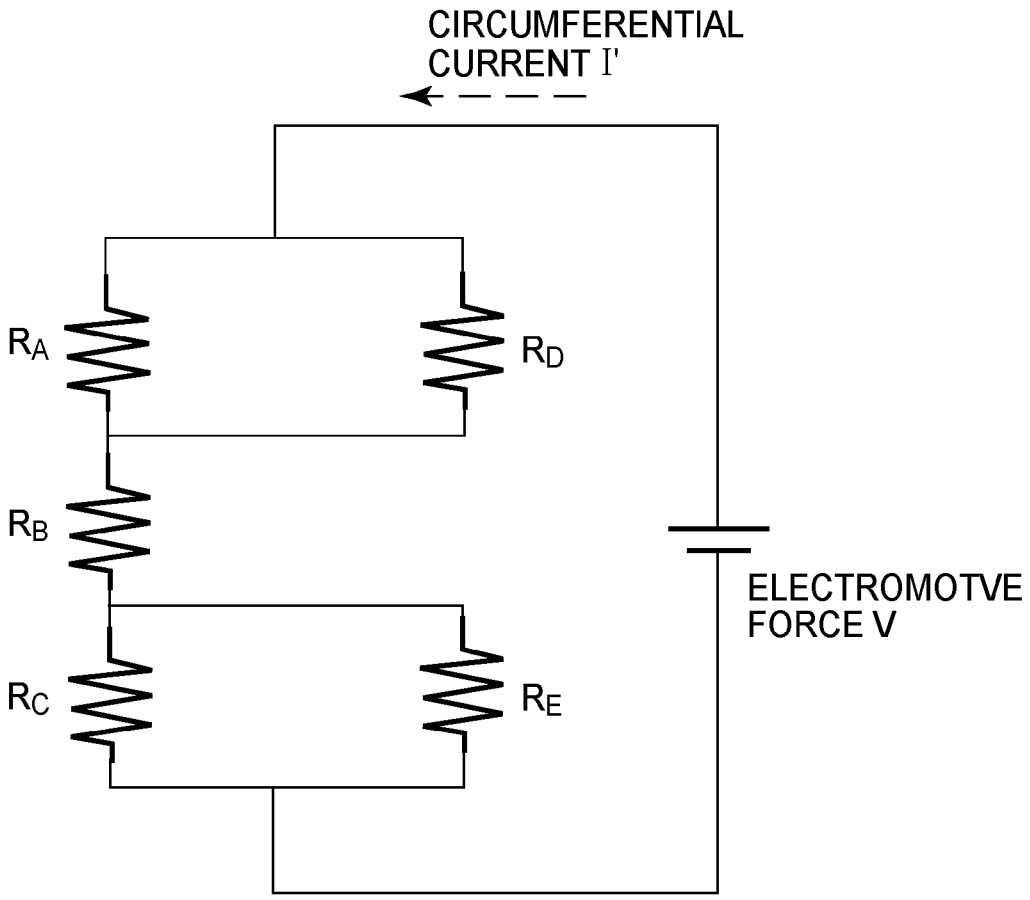
FIG. 15 is an electric circuit diagram showing the case in which the electroconductive layer in FIG. 14 is replaced with resistors.

When a cut-away depth of the cut-away portion 20 with respect to the generatrix direction of the cylindrical rotatable member 1 is a and a cut-away width of the cut-away portion 20 with respect to the circumferential direction of the cylindrical rotatable member 1 is b, as shown in (b) of FIG. 14, the region of the electroconductive layer 1*a* can be considered by being divided into 5 zones (regions) A to E. When electric resistances in these 5 zones A to E are RA to RE, respectively, and approximation that only the current flowing through the electroconductive layer 1*a* in the circumferential direction contributes to the heat generation is made, the circuit shown in (b) of FIG. 14 can be rewritten into a circuit diagram of FIG. 15. In FIG. 15, a total resistance R' of the electroconductive layer is represented by the following formula (41).

$$R' = \frac{R_A R_D}{R_A + R_D} + R_B + \frac{R_C R_E}{R_C + R_E} \tag{41}$$

The number of cut-away portions 20 in this case is 1, and therefore, when the case where the cut-away portion 20 is positioned at a central portion of the cylindrical rotatable member 1 with respect to the circumferential direction is considered, RA to RE are represented by the following formulas (42)-(44).

$$R_A = R_C = \frac{\delta - b}{2(L-a)d}\rho \tag{42}$$

$$R_B = \frac{b}{(L-a)d}\rho \tag{43}$$

$$R_D = R_E = \frac{\delta - b}{2ad}\rho \tag{44}$$

When the formulas (42) to (44) are substituted into the formula (41), the total resistance R' can be represented by the following formula (45).

$$R' = \frac{(L-a)\delta + ab}{(L-a)Ld}\rho \tag{45}$$

Therefore, the heat generation amount at the total resistance, i.e., an entire heat generation amount W' of the electroconductive layer 1*a* in the case where the electromotive force V is applied to the electroconductive layer 1*a* of (b) of FIG. 14 is acquired by the following formula (46).

$$W' = \frac{v^2}{R'} = \frac{(L-a)Ld}{(L-a)\delta + ab}\frac{v^2}{\rho} \tag{46}$$

In the case of the same electromotive force V, when the formula (46) of the heat generation amount W' in the case where the cut-away portion 20 is provided and the formula (39) of the heat generation amount W in the case where the cut-away portion 20 is not provided are compared with each other, the following formula (47) is obtained.

$$\frac{W'}{W} = \frac{(L-a)\delta}{(L-a)\delta + ab} < 1 \quad (\because ab > 0) \tag{47}$$

From the formula (47), W'<W holds and therefore it was shown that the excessive heat generation is suppressed by the cut-away portion 20.

4-2) Principle of Local Heat Generation at Cut-Away End Portion

In the case where the circuit diagram as shown in (b) of FIG. 14 is considered, it was shown that the heat generation amount of the entirety of the electroconductive layer 1*a* can be reduced by providing the cut-away portion 20. However, on the other hand, in the zone B positioned at the cut-away end portion, an amount of a current increases due to circumventing currents from the zones D and E, so that local heat generation occurs in some cases. By this local heat generation at this cut-away end portion, there is a possibility that the heat generation leads to a problem such as breakage of the fixing member.

In the fixing device of a type in which heating is made by the circumferential current flowing through the electroconductive layer 1*a* as shown in this embodiment, the case where the electroconductive layer 1*a* of the cylindrical rotatable member 1 is provided with the cut-away portion 20 and the case where the electroconductive layer 1*a* is not provided with the cut-away portion 20 are compared with each other. Further, by the presence of the cut-away portion 20, a principle of local heat generation at the cut-away end portion and its suppressing method will be described using electric network calculation.

A heat generation amount WB in the zone B positioned at the cut-away end portion is represented by the following formula (48) in a condition of the circuit diagram of FIG. 15.

$$W_B = I'^2 R_B = \frac{R_B v^2}{R'^2} \tag{48}$$

When the formulas (43) and (45) are substituted into the formula (48), the following formula (49) is acquired.

$$W_B = \frac{L^2(L-a)bd}{\{L\delta - a(\delta - b)\}^2}\frac{v^2}{\rho} \tag{49}$$

By dividing the formula (49) by a volume of the zone B, a heat generation amount per unit volume ωB of the electroconductive layer 1*a* in the zone B is represented by the following formula (50).

$$\omega_B = \frac{w_B}{(L-a)bd} = \frac{L^2}{\{L\delta - a(\delta - b)\}^2}\frac{v^2}{\rho} \tag{50}$$

When the formula (50) showing the heat generation amount per unit volume ωB of the electroconductive layer 1*a* in the zone B positioned at the cut-away end portion and the formula (40) showing the heat generation amount per unit volume ω of the electroconductive layer 1*a* in the case where there is no cut-away portion are compared with each other in the case where the same electromotive force V is applied, the following formula (51) is derived.

$$\frac{\omega_\delta}{\omega} = \left\{\frac{L\delta}{L\delta - a(\delta - b)}\right\}^2 > 1 \tag{51}$$

$$(\because a(\delta - b) > 0)$$

From the formula (51), ωB>ω holds, and therefore, it was able to be confirmed that the local heat generation occurred at the cut-away end portion. From the formula (51), in order to suppress the local heat generation, it is understood that it is effective to minimize a(θ−b).

That is, a small cut-away depth a and a large cut-away width b are advantageous for suppressing the local heat generation. A general concern about the local heat generation is that the temperature of the fixing member exceeds a heat-resistant temperature and causes a phenomenon such as breakage of the fixing member. Therefore, when a target temperature of the electroconductive layer 1*a* in the sheet-passing region is TM and a heat-resistant temperature of the fixing member adjacent to the electroconductive layer 1*a* is TL, it is preferable that the cut-away depth a and the cut-away width b are set to satisfy the following formula (52).

$$\frac{\omega_\delta}{\omega} = \left\{\frac{L\delta}{L\delta - a(\delta - b)}\right\}^2 < \frac{T_L}{T_M} \tag{52}$$

4-3) Case where there are Plurality of Cut-Away Portions

Figure 16:
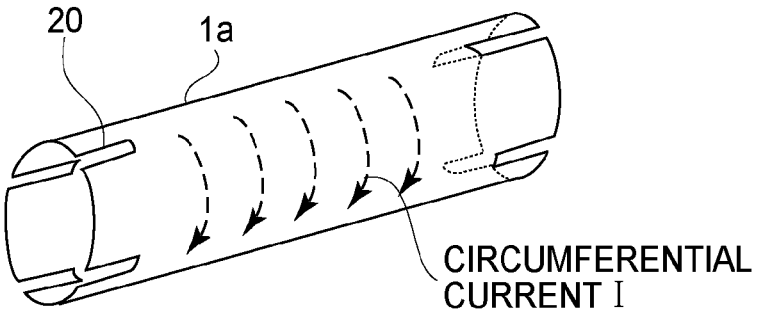
In FIG. 16, (a) is a perspective view of an electric conductive layer having a plurality of cut-away portions, and (b) and (c) are a schematic view and an equivalent circuit diagram, respectively, showing the case in which the circumferential current flows through the electroconductive layer having the plurality of cut-away portions.
Figure 16:
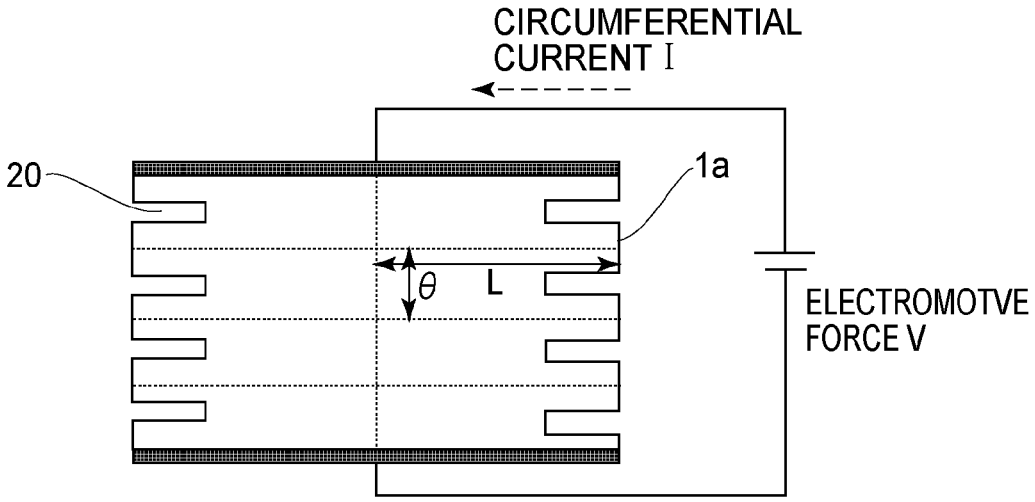
Figure 16:
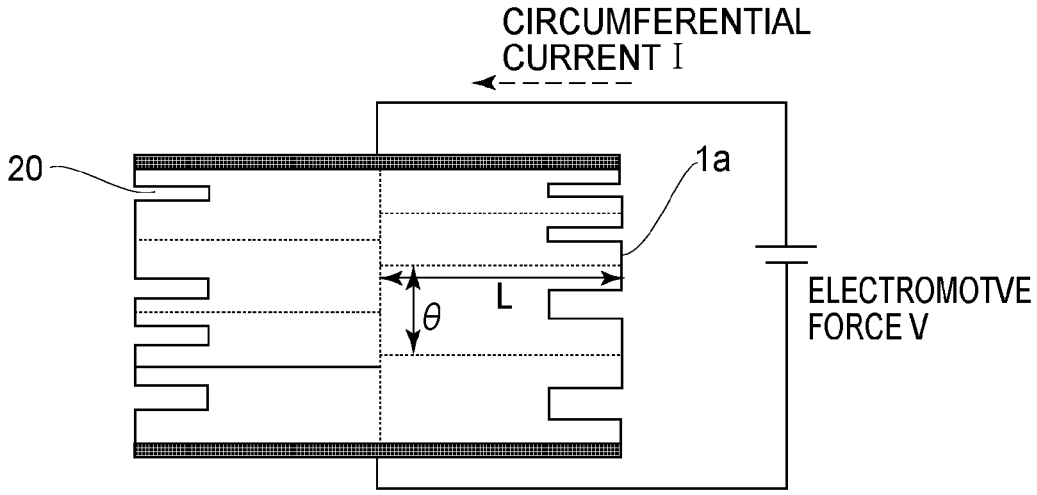

In FIG. 16, (a) is a perspective view of an electroconductive layer 1*a* of the cylindrical rotatable member 1 in the case where the electroconductive layer 1*a* is provided with a plurality of cut-away portions at each of end portions thereof. As an equivalent circuit, a circuit in which the electroconductive layer 1*a* of the cylindrical rotatable member 1 is cut away and a DC voltage is applied to both ends (terminals) is shown in (b) of FIG. 16. In this case, by estimating a local heat generation amount at a cut-away end portion for each of regions defined by broken lines in the figure, it is possible to assume a cut-away shape which does not cause the fixing member breakage.

In the formula (47) showing a suppression proportion of the excessive heat generation and the formula (51) showing the local heat generation of the cut-away portion, L is defined as an effective length of the electroconductive layer 1*a* with respect to the generatrix direction and θ is defined as an effective length of the electroconductive layer 1*a* with respect to the circumferential direction. In the case where the electroconductive layer 1*a* is provided with the cut-away portion only at one end portion, "L=length of electroconductive layer with respect to generatrix direction" is kept as it is.

However, as shown in (a) of FIG. 16, in the case where the electroconductive layer 1*a* is provided with the cut-away portion at each of end portions, "L=(length of electroconductive layer with respect to generatrix direction)/2" is used. Further, in the case where the electroconductive layer 1*a* is provided with n cut-away portions which are equidistantly spaced with respect to the circumferential direction at each of the end portions with respect to the generatrix direction, "θ=(length of electroconductive layer with respect to circumferential direction)/n" is used.

In the case in which as shown in (c) of FIG. 16, the cut-away portions are not equidistantly disposed, as indicated by broken lines in (c) of FIG. 16, the region of the electroconductive layer 1*a* is divided on the basis of a mid-point line (horizontal broken line) between adjacent cut-away portions with respect to the circumferential direction, so that θ can be obtained.

4-4) Difference Depending on Cut-Away Shape

Figure 17:
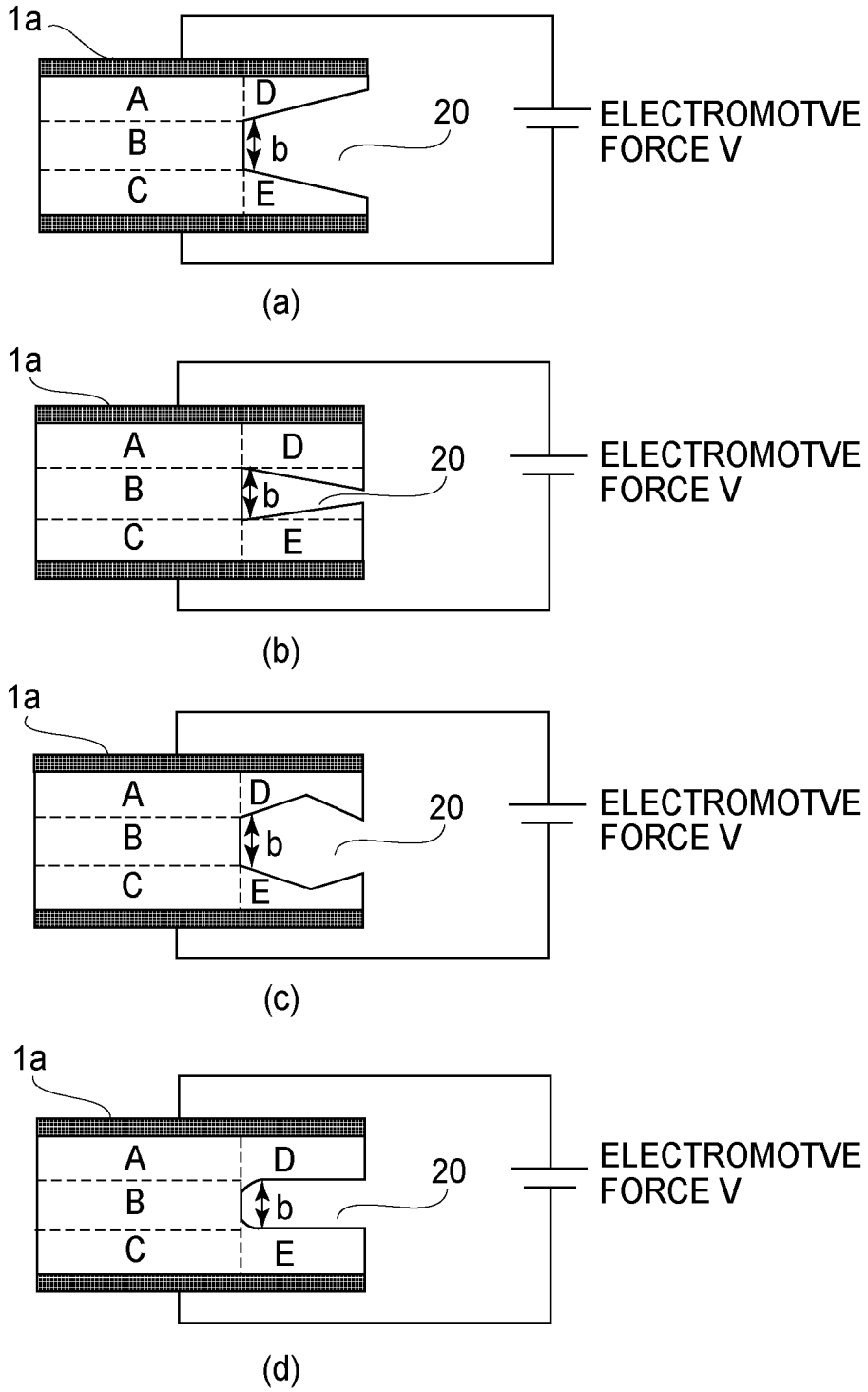
In FIG. 17, (a) to (d) are equivalent circuit diagrams each showing the case in which a shape of a cut-away portion is other than a substantially rectangular shape.

In FIG. 17, (a) to (d) are circuit diagrams each showing an example of the case where the electroconductive layer 1*a* is provided with a cut-away shape other than a rectangular shape (inclusive of a substantially rectangular shape). In these cases, strictly, it is desirable that in each of the circuit diagrams, the resistance value formula (44) in each of the zones D and E of the electroconductive layer 1*a* is defined again and then is calculated.

However, when the formula (47) showing the suppression proportion of the excessive heat generation by the cut-away portion 20 and the formula (52) for suppressing the fixing member breakage due to the local heat generation at the cut-away end portion are only checked, it is only required that attention is focused on the cut-away shape and the formulas (47) and (52) are solved.

For example, in the cases of trapezoidal cut-away portions as shown in (a) and (b) of FIG. 17 and a polygonal cut-away portion as shown in (c) of FIG. 17, the cut-away width b of the formulas (47) and (52) is defined again as "cut-away width with respect to circumferential direction of cylindrical rotatable member at cut-away end portion". Further, in the case where a curved shape is provided at the cut-away end portion as shown in (d) of FIG. 17, the cut-away, width bat a terminal points of the curve is defined.

4-5) Summary of Cut-Away Portion 20

The cut-away portion 20 has a size of a (mm) in cut-away depth with respect to the generatrix direction of the electroconductive layer 1*a* and *b* (mm) in cut-away width with respect to the circumferential direction of the electroconductive layer 1*a*, and the cut-away depth a (mm) and the cut-away width b (mm) satisfy the following formula [1].

$$(L\theta/(L\theta-a(\theta-b))^2<T_L/T_M \quad [1]$$

In this formula, L is an effective length (mm) of the electroconductive layer 1*a* with respect to the generatrix direction, and is a generatrix direction length of the electroconductive layer 1*a* in the case where the electroconductive layer 1*a* is provided with the cut-away portion 20 only at one end portion. In a case in which the electroconductive layer 1*a* is provided with the cut-away portions 20 at each of the end portions, L is ½ of the generatrix direction length of the electroconductive layer 1*a*. θ is an effective length (mm) of the electroconductive layer 1*a* with respect to the circumferential direction, and is a circumferential length of the electroconductive layer 1*a* in the case where the electroconductive layer 1*a* is provided with a single cut-away portion 20 at one end portion. Further, in the case where the electroconductive layer 1*a* is provided with 2 or more cut-away portions 20 at one end portion, θ is a length from a mid-point line with one adjacent cut-away portion to a mid-point line with the other adjacent cut-away portion. TM is a surface temperature (° C.) of the electroconductive layer 1*a* in the sheet-passing region, and TM is a heat-resistant temperature (° C.) of each of the fixing members.

In the case where the cut-away portion 20 has a shape other than the rectangular shape (inclusive of the substantially rectangular shape, when at a free end portion of the cut-away portion 20, the cut-away depth and the cut-away width are defined again as a (mm) and b (mm), respectively, the above-described formula [1] is satisfied.

In the case where the cut-away portion 20 is provided with the curved shape at the free end portion thereof, the cut-away width b at the terminal point of the curve is defined.

In the above-described formula [1], TL is the heat-resistant temperature of the electric layer 1*b* laminated on the electroconductive layer 1*a*.

4-5] Confirmation of Effect

An effect of the heat generation principle of the fixing device in this embodiment described above using the network calculation was confirmed by an experiment. Further, by comparison between an experimental result and a calculation result of the network calculation, validity of estimation by the calculation was confirmed.

Embodiment 1

Table 6 appearing hereinafter shows a result of comparison between the presence and absence of the core 2 in terms of an electric power reduction amount by the cut-away portion 20. In Embodiment 1, a fixing device is the fixing device A described with reference to FIGS. 1 and 3, and the fixing sleeve 1 is a cylindrical rotatable member which has the composite structure of the electroconductive layer 1*a*, the electric layer 1*b* and the parting layer 1*c* and which is provided with the cut-away portion 20, as described with reference to (a) of FIG. 2.

The electroconductive layer 1*a* of the fixing roller 1 is formed of a steel having a thickness of 0.5 mm, a diameter of 30 mm (about 94 mm in length with respect to the circumferential direction) and a longitudinal length of 260 mm as described in JP-A 2003-330291. On an outer peripheral surface of the electroconductive layer 1*a*, a 0.3 mm-thick electric layer 1*b* having a hardness (JIS-A, 1 kg load) of 20 degrees is molded with silicone rubber. Then, on the electric layer 1*b*, as the surface layer 1*c* (parting layer), a 20 μm-thick fluorine-containing tube is coated.

In Comparison Example 1 shown in Table 6, a fixing device in which the core 2 of the fixing device of Embodiment 1 is removed is used. The fixing sleeve 1 includes the electroconductive layer 1*a* provided with 4 cut-away portions which are each 10 mm in width and 20 mm in depth and which are substantially equidistantly disposed at each of end portions of the electroconductive layer 1*a*.

The temperature of an entirety of the region of the fixing sleeve 1 is measured using an infrared thermography ("R300-SR", manufactured by Nippon Avionics, Co., Ltd.), and supplied electric power to the high-frequency converter 16 is adjusted so that the surface temperature of the fixing sleeve 1 at a longitudinal central portion is 170° C.

Necessary supplied electric power in the case where the electroconductive layer 1*a* is not provided with the cut-away portion 20 is 800 W in both of Embodiment 1 and Comparison Example 1. Relative to 800 W, an electric power reduction amount by the cut-away portion 20 is shown in Table 6.

TABLE 6

| | Core | NEP(N)*1 | NEP(Y)*2 | EPR*3 |
|---|---|---|---|---|
| EMB. 1 | YES | 800 W | 740 W | 60 W |
| COM. EX. 1 | NO | 800 W | 750 W | 50 W |

*1"NEP(N)" is the necessary electric power with no cut-away portion.
*2"NEP(Y)" is the necessary electric power with the cut-away portion.
*3"EPR" is the electric power reduction amount.

From Table 6, it is understood that the electric power reduction amount is larger in Embodiment 1 than in Comparison Example 1 and thus the electric power can be efficiently reduced by the cut-away portion 20 in the case of Embodiment 1. In the case in which the electric power reduction amount in Comparison Example 1 is 100%, in Embodiment 1, the reduction amount (degree) is improved by 20%.

This is attributable to heat generation due to the circumferential current generating in the circumferential direction of the electroconductive layer 1*a* in Embodiment 1 compared with heat generation due to the eddy current generating in the electroconductive layer 1*a* in Comparison Example 1. That is, Table 6 shows that an electric power reduction efficiency is higher in a method in which the direction of the circumferential current is changed as in Embodiment 1 than in a method in which the region of the electroconductive layer 1*a* generated by the eddy current is reduced.

Other Embodiments

Table 7 appearing hereinafter shows experimental results and calculation results of an excessive heat generation suppression proportion W'/W and a local heat generation proportion ωB/ω) at the cut-away end portion in Embodiments 2 to 7 in the case where the depth a and the width b of the cut-away portion 20 are changed.

Fixing device constitutions other than the cut-away shape in Embodiments 2 to 7 are substantially the same as the fixing device constitution in Embodiment 1.

At this time, the electroconductive layer 1*a* of the fixing sleeve 1 is formed of SUS 304 having a thickness of 35 μm, a diameter of 30 mm (about 94 mm in length with respect to the circumferential direction) and a longitudinal length of 260 mm. Further, at each of end portions of the electroconductive layer 1*a*, 4 cut-away portions having the same shape are provided and are substantially disposed equidistantly with respect to the circumferential direction of the electroconductive layer 1*a*. The depths a and the widths b of the cut-away portions 20 in the respective embodiments are different from each other as shown in Table 7.

The cut-away depth and width in Embodiment 5 was set by making reference to the slit shape disclosed in JP-A 2003-330291.

The temperature of an entirety of the region of the fixing sleeve 1 is measured using an infrared thermography ("R300-SR", manufactured by Nippon Avionics, Co., Ltd.), and supplied electric power to the high-frequency converter 16 is adjusted so that the surface temperature of the fixing sleeve 1 at a longitudinal central portion is 170° C.

Necessary supplied electric power in the case where the electroconductive layer 1*a* is not provided with the cut-away portion 20 is 600 W. In the experiment, the excessive heat generation suppression proportion was defined as "W'/W=(supplied electric power with cut-away portion)/(supplied electric power with no cut-away portion)". Further, in the calculation, the heat generation suppression proportion was acquired by the formula (47).

On the other hand, in the experiment, the local heat generation proportion at the cut-away end portion was defined as "ωB/ω)=(fixing sleeve surface temperature at cut-away end portion)/(fixing sleeve surface temperature at longitudinal central portion)". Further, in the calculation, the local heat generation proportion at the cut-away end portion was acquired by the formula (51).

In Embodiments 2 to 4 in Table 7, the cut-away width b is fixed at 5 mm, and the cut-away depth a is changed. When the experimental results and the calculation results are compared with each other, it is understood that the excessive heat generation suppression proportion W'/W is lower with an increasing cut-away depth a, but the local heat generation proportion ωB/ω is higher with the increasing cut-away depth a. Further, the experimental results and the calculation results roughly ensure good coincidence.

In Embodiments 4 to 7 in Table 7, the cut-away depth a is fixed at 20 mm, and the cut-away width b is changed. When the experimental results and the calculation results are compared with each other, it is understood that both of the excessive heat generation suppression proportion W'/W and the local heat generation proportion ωB/ω are lower with the increasing cut-away depth a, and are advantageous for reduction in excessive heat generation and suppression of the local heat generation. Further, the experimental results and the calculation results roughly ensure good coincidence.

Further, from these results, it is understood that in the case of Embodiment 5 in which the cut-away width b is 0.5 mm, which is narrow, an excessive heat generation suppressing effect is achieved, but on the other hand, there is a risk of breakage of the fixing member. In the case of the fixing device in this embodiment, a most severe member, in terms of the heat-resistant temperature of the fixing member, is the electric layer 1*b* which is laminated on the electroconductive layer 1*a* and which is formed of the silicone rubber, and is 230° C. in heat-resistant temperature TL. In the fixing device in this embodiment, when a target fixing temperature TM of plain paper is 170° C., TL/TM in the formula (52) is about 1.35.

In Embodiment 5, the local heat generation proportion ωB/ω is 1.43 in experimental result and 1.39 in calculation result and exceeds 1.35 in either case. This shows a possibility that in the fixing device in which heat is generated by passing the circumferential current through the electroconductive layer 1*a* as in the fixing device in this embodiment, when the electroconductive layer 1*a* is provided with the cut-away portion of about 0.5 mm in width and about 20 mm in depth disclosed in JP-A 2003-330291, breakage of the electric layer 1*b* is caused.

From the above-described consideration, it was confirmed that the excessive heat generation suppressing effect is obtained in Embodiment 5 but there is a risk of breakage of the electric layer 1*b* of the fixing sleeve 1. In order to avoid this risk, the cut-away shape may desirably satisfy the above-described formula (52).

Further, as the other constitution for avoiding the risk, a layer structure in which the cut-away portion 20 and the electric layer 1*b* are spaced from each other so as not to overlap with each other with respect to the longitudinal direction as in the case of the fixing sleeve 1 shown in (b) of FIG. 2.

TABLE 7

| | | | W'/W | | ωB/ω | |
|---|---|---|---|---|---|---|
| EMB. | a (mm) | b (mm) | E*1 | C*2 | E*1 | C*2 |
| 2 | 5 | 5 | 0.990 | 0.992 | 1.08 | 1.06 |
| 3 | 10 | 5 | 0.981 | 0.983 | 1.14 | 1.13 |
| 4 | 20 | 5 | 0.960 | 0.963 | 1.30 | 1.29 |
| 5 | 20 | 0.5 | 0.997 | 0.996 | 1.43 | 1.39 |
| 6 | 20 | 3 | 0.978 | 0.977 | 1.35 | 1.33 |
| 7 | 20 | 10 | 0.925 | 0.928 | 1.21 | 1.20 |

*1"E" is the experimental result.
*2"C" is the calculation result.

Table 8 appearing hereinafter shows experimental results and calculation results of the excessive heat generation suppression proportion W'/W and the local heat generation proportion ωB/ω at the cut-away end portion in Embodiment 8 in which the electroconductive layer 1*a* is provided with the cut-away portion 20 in only at one end portion ("ONE") and in Embodiments 7 and 9 to 11 in which the electroconductive layer 1*a* is provided with the cut-away portion(s) 20 in both of end portions ("BOTH") while changing the number of the cut-away portion(s). Other experimental and calculation conditions are the same as those in Table 7. Further, in Embodiments 7-11, each cut-away portion 20 is 20 mm in depth a and 5 mm in width b. Further, in each of Embodiments 7-11, the cut-away portions 20 are substantially equidistantly disposed with respect to the circumferential direction.

In Table 8, a difference between Embodiments 7 and 8 is that the cut-away portions 20 are provided at both of the end portions (Embodiment 7) or only at one end portion (Embodiment 8). In Embodiment 7 in which the cut-away portions 20 are provided at both of the end portions, the excessive heat generation suppression proportion W'/W is low and is advantageous. However, as regards the local heat generation proportion ωB/ω, its value is low and advantageous in Embodiment 8. Further, the experimental results and the calculation results ensure good coincidence.

In Embodiments 7 and 9 to 11 in Table 8, both of the excessive heat generation suppression proportion W'/W and the local heat generation proportion ωB/ω are lower with an increasing number of the cut-away portion(s) and thus are advantageous in terms of the excessive heat generation reduction and the local heat generation suppression. Further, the experimental results and the calculation results ensure good coincidence.

TABLE 8

| EMB. | N*1 | P*2 | W'/W | | ωB/ω | |
|---|---|---|---|---|---|---|
| | | | E*3 | C*4 | E*3 | C*4 |
| 7 | 4 | BOTH | 0.925 | 0.928 | 1.20 | 1.20 |
| 8 | 4 | ONE | 0.980 | 0.983 | 1.12 | 1.09 |
| 9 | 1 | BOTH | 0.992 | 0.991 | 1.35 | 1.34 |
| 10 | 2 | BOTH | 0.960 | 0.963 | 1.30 | 1.29 |
| 11 | 8 | BOTH | 0.899 | 0.896 | 1.11 | 1.12 |

*1"N" is the number of the cut-away portion(s).
*2"P" is the position of the cut-away portion(s).
*3"E" is the experimental result.
*4"C" is the calculation result.

Table 9 appearing hereinafter shows experimental results and calculation results of the excessive heat generation suppression proportion W'/W and the local heat generation proportion ωB/w in the case of using the fixing device in Embodiment 7 and the fixing devices in Embodiments 12 to 15 in which the substantially rectangular cut-away shape in Embodiment 7 is changed to those shown in (a) to (d) of FIG. 17, respectively. Conditions other than the cut-away shape are the same as those in Embodiment 7. In Embodiments 12 to 14, each of the cut-away portions is 20 mm in depth a to a leading end of the cut-away shape and 10 mm in width b at the leading end of the cut-away shape. The cut-away shape in Embodiment 15 is provided with a curved portion at the leading end thereof and is 20 mm in depth a to the leading end of the cut-away shape and 10 mm in width b at starting and end points of the curved portion.

From Table 9, it is understood that irrespective of the difference in cut-away shape, each of the excessive heat generation suppression proportion W'/W and the local heat generation proportion ωB/ω shows approximately the same value. Further, the experimental results and the calculation results ensure good coincidence.

TABLE 9

| EMB. | CS*1 | W'/W | | $\omega_B/\omega$ | |
|---|---|---|---|---|---|
| | | E*2 | C*3 | E*2 | C*3 |
| 7 | 14(b) | 0.925 | 0.928 | 1.20 | 1.20 |
| 12 | 17(a) | 0.921 | 0.928 | 1.18 | 1.20 |
| 13 | 17(b) | 0.930 | 0.928 | 1.20 | 1.20 |
| 14 | 17(c) | 0.923 | 0.928 | 1.19 | 1.20 |
| 15 | 17(d) | 0.925 | 0.928 | 1.22 | 1.20 |

*1"CS" is the cut-away shape in the associated figure.
*2"E" is the experimental result.
*3"C" is the calculation result.

As described above, in the fixing device in which the helically-shaped coil 3 and the magnetic core 2 for inducing the magnetic line of force are provided inside an inner peripheral surface of the cylindrical rotatable member 1 having the electroconductive layer 1*a*, the electroconductive layer 1*a* is provided with the cut-away portion 20. As a result, the heat generation due to the circumferential current in the non-sheet-passing region can be efficiently suppressed. Further, the shape of the cut-away portion 20 satisfies the formula (52), so that it is possible to suppress the breakage of the electric layer 1*b* of the fixing sleeve 1 due to the local heat generation.

The fixing device A is not limited to the fixing device for heating and fixing the unfixed toner image formed on the recording material. The fixing device A also includes a device used in a process of adjusting surface glossiness of an image by re-heating the toner image which is partly fixed or completely fixed (also in this case, the device will be referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-228557 filed on Nov. 24, 2015, which is hereby incorporated by reference herein in its entirety.

What is claimed is:

1. A fixing device for fixing an image on a recording material, said fixing device comprising:

a cylindrical rotatable member including an electroconductive layer and having at least one slit at an end portion with respect to a generatrix direction of said rotatable member;

a coil, provided inside said rotatable member, said coil including a helically-shaped portion having a helical axis along the generatrix direction of said rotatable member and forming an alternating magnetic field for causing the electroconductive layer to generate heat through electromagnetic induction heating; and a magnetic core provided inside the helically-shaped portion, wherein said magnetic core does not form a loop outside the electroconductive layer, wherein 70% or more of magnetic lines of force coming out of one end of said magnetic core and passing through an outside of the electroconductive layer return to another end of said magnetic core, and wherein the image is fixed on the recording material by the heat generated through the electroconductive layer of said rotatable member.

2. The fixing device according to claim 1, wherein said rotatable member has a plurality of slits provided at a plurality of positions, the plurality of slits being spaced with intervals with respect to a circumferential direction.

3. The fixing device according to claim 1, wherein the at least one slit is provided at each of layer end portions of said rotatable member.

* * * * *